US008543033B2

(12) United States Patent
Morishita

(10) Patent No.: US 8,543,033 B2
(45) Date of Patent: Sep. 24, 2013

(54) PROCESS UNIT POSITIONING DEVICE AND IMAGE FORMING APPARATUS INCLUDING THE SAME

(75) Inventor: Hiroki Morishita, Osaks (JP)

(73) Assignee: Kyocera Document Solutions, Inc., Osaka (JP)

( * ) Notice: Subject to any disclaimer, the term of this patent is extended or adjusted under 35 U.S.C. 154(b) by 331 days.

(21) Appl. No.: 12/985,533

(22) Filed: Jan. 6, 2011

(65) Prior Publication Data

US 2011/0182615 A1 Jul. 28, 2011

(30) Foreign Application Priority Data

Jan. 27, 2010 (JP) ..... 2010-015067
Mar. 16, 2010 (JP) ..... 2010-058858

(51) Int. Cl.
*G03G 21/16* (2006.01)
*G03G 15/00* (2006.01)
*G03G 21/12* (2006.01)

(52) U.S. Cl.
USPC ..... 399/111; 399/117; 399/360

(58) Field of Classification Search
USPC ..... 399/107, 111, 116, 117, 358, 360
See application file for complete search history.

(56) References Cited

U.S. PATENT DOCUMENTS

| | | | | |
|---|---|---|---|---|
| 6,101,349 | A | 8/2000 | Ohashi et al. | |
| 6,477,346 | B1 * | 11/2002 | Yahagi | 399/117 |
| 7,400,851 | B2 * | 7/2008 | Kuma et al. | 399/299 |
| 7,519,312 | B2 | 4/2009 | Izumi et al. | |
| 7,620,358 | B2 * | 11/2009 | Kadowaki et al. | 399/358 |
| 2004/0170446 | A1 * | 9/2004 | Nagashima et al. | 399/111 |
| 2005/0008393 | A1 * | 1/2005 | Kuma et al. | 399/110 |
| 2005/0260019 | A1 | 11/2005 | Arai | |
| 2006/0110195 | A1 | 5/2006 | Fuji et al. | |
| 2007/0002122 | A1 * | 1/2007 | Murano et al. | 347/115 |
| 2007/0071502 | A1 * | 3/2007 | Shimizu | 399/258 |
| 2007/0160383 | A1 * | 7/2007 | Matsumoto et al. | 399/110 |
| 2009/0097879 | A1 * | 4/2009 | Nagashima et al. | 399/120 |
| 2009/0252526 | A1 * | 10/2009 | Kadowaki | 399/99 |

FOREIGN PATENT DOCUMENTS

| | | |
|---|---|---|
| JP | 7-306566 | 11/1995 |
| JP | 2002-139976 | 5/2002 |
| JP | 2007-10850 | 1/2007 |
| JP | 2009-115836 | 5/2009 |

* cited by examiner

*Primary Examiner* — Sandra Brase
(74) *Attorney, Agent, or Firm* — Smith Gambrell & Russell, LLP

(57) ABSTRACT

Provided is a process unit positioning device which performs positioning of a plurality of process units with respect to an apparatus main body, including: a positioning plate in which bearing holes into which individual drum shafts are fitted and a fitted portion onto which positioning portion of the apparatus main body is fitted are formed; and a holder portion supported by the apparatus main body so as to be able to pivot while holding the positioning plate so that a position changes by contact between the bearing holes and the drum shafts.

13 Claims, 28 Drawing Sheets

PROCESS UNIT POSITIONING DEVICE AND IMAGE FORMING APPARATUS INCLUDING THE SAME

This application is based upon and claims the benefit of priority from the corresponding Japanese Patent Application No. 2010-015067 filed on Jan. 27, 2010 and the corresponding Japanese Patent Application No. 2010-058858 filed on Mar. 16, 2010, the entire contents of which are incorporated herein by reference.

BACKGROUND OF THE INVENTION

1. Field of the Invention

The present invention relates to a process unit positioning device which performs mutual positioning of process units individually including photosensitive drums corresponding to different colors of toner, and an image forming apparatus which includes the process unit positioning device and forms a full-color image.

2. Description of Related Art

Up to now, different kinds of so-called four-tandem structure are proposed as an image forming apparatus which uses respective colors of toner, that is, yellow, cyan, magenta, and black, to form a full-color image by electrophotographic process. The image forming apparatus of this kind has a structure for obtaining a full-color image by arranging four photosensitive drums corresponding to the above-mentioned respective colors in parallel and superimposing toner images, which are obtained by developing electrostatic latent images on the respective photosensitive drums with the respective colors of toner, successively on an intermediate transfer member or a paper sheet.

The four-tandem image forming apparatus as described above needs to maintain high mutual positioning accuracy for process units individually including the respective photosensitive drums in order to prevent the toner images in the respective colors from being displaced from one another on the intermediate transfer member or the paper sheet. In a normal state, drum shafts of the respective photosensitive drums are supported by a positioning plate having bearing holes into which the respective drum shafts are fitted, which enables positioning of the respective process units with high accuracy.

Incidentally, the respective process units need to be replaced by a user because of machine life (for example, life of photosensitive drums) when the number of sheets printed reaches to a predetermined number (for example, tens of thousands of sheets). Therefore, in order to replace the respective process units, the positioning plate needs to be structured to be detachable/attachable from/to an apparatus main body.

For example, in some image forming apparatuses, a handle is formed on the positioning plate, and the user can grip the handle to fit the positioning plate onto the respective drum shafts (to fit the drum shafts into the bearing holes of the positioning plate) and to draw out the positioning plate from the respective drum shafts (to release the fit of the drum shafts into the bearing holes). The positioning plate drawn out from the respective drum shafts is placed on a different site outside the apparatus main body, thereby being completely separated from the apparatus main body.

However, in the case where the positioning plate is completely separated from the apparatus main body after the positioning plate is drawn out from the respective drum shafts, the user needs to locate a fitting position of the positioning plate with a sense of his/her hand in order to fit the positioning plate onto the respective drum shafts after the replacement of the respective process units, which inhibits the positioning plate from being fitted smoothly. This reduces workability in replacement of the respective process units. Further, the positioning plate is placed outside the apparatus main body after the positioning plate is drawn out from the respective drum shafts, and hence a moving distance for mounting/removal of the positioning plate to/from the apparatus main body is long, which further reduces the above-mentioned workability.

Further, in the case of mounting the positioning plate to the apparatus main body, when a fitting direction of the drum shafts toward the bearing holes does not coincide with a drum shaft direction because, for example, the fitting direction is inclined toward the drum shaft direction, the drum shafts become hard to be fitted into the bearing holes due to increased frictional resistance and stress caused upon contact.

Further, in the case of replacing the process units, developing rollers arranged in abutment with or in proximity to the respective photosensitive drums need to be retracted from the photosensitive drums. For example, a developing device is disclosed which is provided with a roller separating/contacting mechanism for bringing the developing roller into contact with the photosensitive drum in accordance with an action of attaching the developing device to an image forming apparatus main body or a closing action of an open/close unit while retracting the developing roller from the photosensitive drum in accordance with an action of removing the developing device or an opening action of the open/close unit. More specifically, in the above-mentioned roller separating/contacting mechanism, a shaft member for separating/bringing the developing roller from/into contact with the photosensitive drum is provided so as to protrude from a front surface of a developing unit, and the shaft member is pushed by the positioning plate to thereby bring the developing roller into proximity to the photosensitive drum while the positioning plate is opened to thereby retract the developing roller from the photosensitive drum.

However, this structure necessitates a certain amount of force to attach the positioning plate due to a reaction force acted upon the shaft member by the attachment of the positioning plate, which inhibits attachment work from being performed smoothly.

SUMMARY OF THE INVENTION

The present invention has been made in order to solve the above-mentioned problems, and a principal object thereof is to provide a process unit positioning device which can improve workability upon attachment/detachment of respective process units and allows drum shafts to be fitted into bearing holes smoothly, and an image forming apparatus including the process unit positioning device.

Another object of the present invention is to provide an image forming apparatus which can improve workability upon attachment/detachment of respective process units by smoothly attaching a positioning plate to an apparatus main body even when the image forming apparatus has a structure provided with a roller separating/contacting mechanism.

According to the present invention, a process unit positioning device has the following structure. Specifically, the process unit positioning device, which performs mutual positioning of process units individually including photosensitive drums corresponding to different colors of toner with respect to an apparatus main body, includes: a positioning plate in which bearing holes into which individual drum shafts of the respective photosensitive drums are fitted and a positioning portion onto which the apparatus main body is fitted are formed; a holder portion provided to the apparatus main body, for inserting/removing the drum shafts relatively into/from the bearing holes by being caused to pivot while holding the positioning plate; and an urging member for urging the positioning plate toward the drum shafts in an axial direction with respect to the holder portion, in which the holder portion holds the positioning plate so that a position with respect to the holder portion changes against urging of the urging member by contact between the bearing holes and the drum shafts when the drum shafts are fitted into the bearing holes by the pivot.

According to the above-mentioned structure, only by supporting the pivot shaft of the holder portion on a side of the apparatus main body, the positioning plate remains held by the holder portion on the side of the apparatus main body even when the drum shafts are pulled out of the bearing holes by a pivot of the holder portion, and after the respective process units are detached, attached, and replaced, the positioning plate can be mounted in a normal position only by pivoting the holder portion in a reverse direction. Therefore, each time the respective process units are detached, attached, and replaced, it is possible to further improve workability upon the detachment, attachment, and replacement of the respective process units than before without the need to locate a mount position of the positioning plate with a sense of the hand.

Further, when the drum shafts are fitted into the bearing holes of the positioning plate by the pivot, frictional resistance caused upon contact between the bearing holes and the drum shafts and the like can be alleviated by a continuous position change of the positioning plate relative to the holder portion. Accordingly, even with a structure that causes the holder portion to pivot, the drum shafts can be fitted into the bearing holes smoothly.

According to the present invention, an image forming apparatus may have the following structure. Specifically, the image forming apparatus includes: the process unit positioning device; and process units individually including photosensitive drums corresponding to different colors of toner, in which the process unit positioning device performs mutual positioning of the respective process units.

Further features and advantages of the present invention will become apparent from the description of embodiments given below.

BRIEF DESCRIPTION OF THE DRAWINGS

FIG. 5A and FIG. 5B are perspective views of the above-mentioned image forming apparatus, in which FIG. 5A is a perspective view illustrating a state of process units before being positioned by a process unit positioning device and FIG. 5B is a perspective view illustrating a state of the process units after being positioned by the process unit positioning device.

FIG. 13A and FIG. 13B are sectional views illustrating the above-mentioned process unit positioning device, in which FIG. 13A is a sectional view illustrating an unpositioned state and FIG. 13B is a sectional view illustrating the positioned state.

FIG. 14A and FIG. 14B are sectional views illustrating a displacement of a flat plate portion of the above-mentioned positioning plate caused when a tip of a drum shaft is brought into contact with a bearing hole of the above-mentioned flat plate portion by a pivot of the above-mentioned process unit positioning device, in which FIG. 14A is a sectional view of a case where the above-mentioned flat plate portion moves in a direction opposite to an urging direction of a coil spring and FIG. 14B is a sectional view of a case where an inclination of the above-mentioned flat plate portion changes.

FIG. 15A and FIG. 15B are sectional views illustrating a displacement of the above-mentioned flat plate portion caused when a tip of a positioning pin is brought into contact with a hole portion of a front side plate of an apparatus main body by the pivot of the above-mentioned process unit positioning device, in which FIG. 15A is a sectional view of the case where the above-mentioned flat plate portion moves in the direction opposite to the urging direction of the coil spring and FIG. 15B is a sectional view of the case where the inclination of the above-mentioned flat plate portion changes.

DETAILED DESCRIPTION OF PREFERRED EMBODIMENTS

First Embodiment

An embodiment of the present invention is described as follows with reference to the drawings. Prior to description of a process unit positioning device according to the present invention, an image forming apparatus to which the process unit positioning device is applied is first described.

(1. Overall Structure of Image Forming Apparatus)

Figure 1:
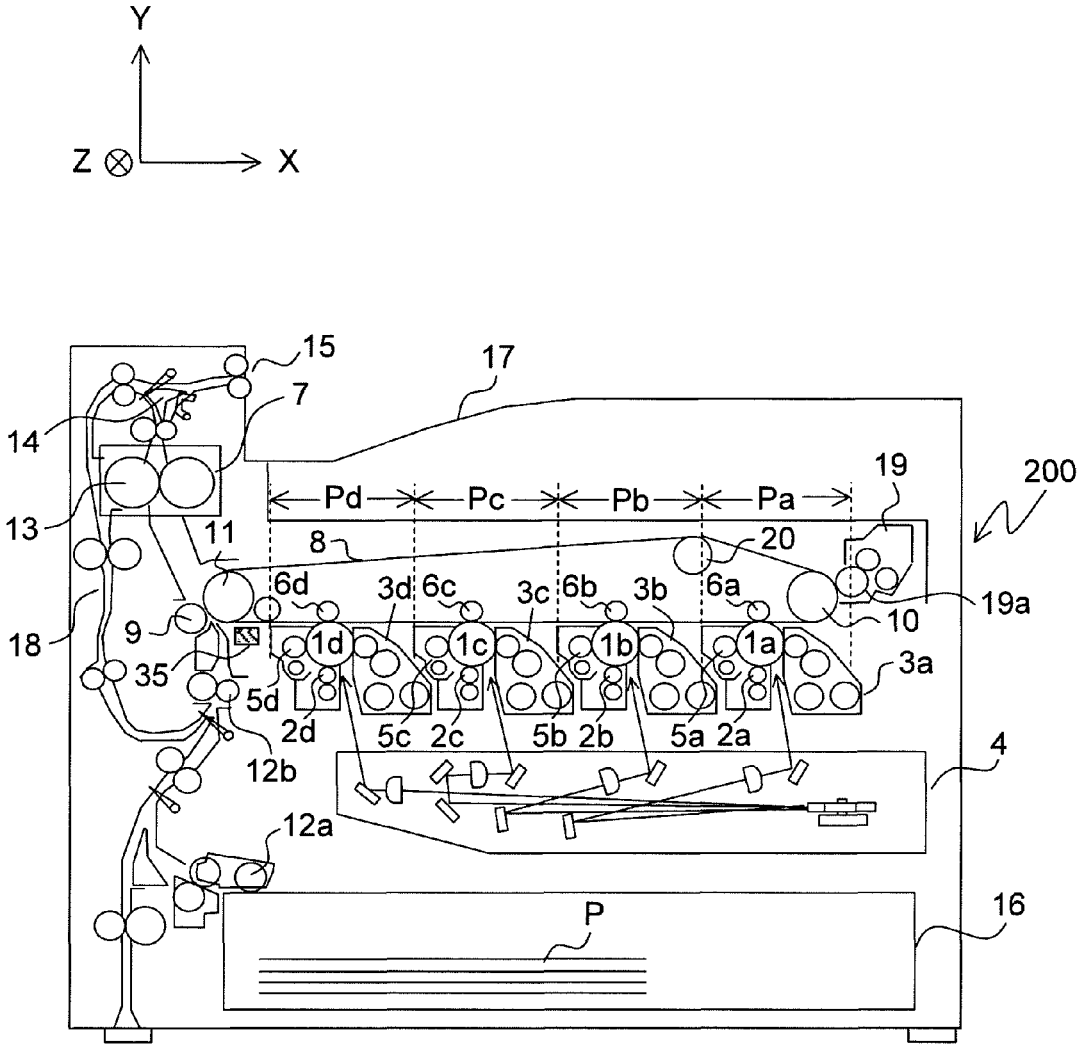
FIG. 1 is a sectional view illustrating a schematic structure of an image forming apparatus according to an embodiment of the present invention.

FIG. 1 is a sectional view illustrating a schematic structure of an image forming apparatus 200 according to this embodiment of the present invention. In this embodiment, the image forming apparatus 200 is structured as a four-tandem color printer for performing image formation by parallelly arranging four photosensitive drums 1*a*, 1*b*, 1*c*, and 1*d* corresponding to different four colors (yellow, cyan, magenta, and black) of toner, respectively.

In FIG. 1, four image forming portions Pa, Pb, Pc, and Pd are horizontally arrayed in order from the right inside an apparatus main body of the image forming apparatus 200. Those image forming portions Pa to Pd are provided corresponding to toner images in different four colors (yellow, cyan, magenta, and black), and respectively form the toner images in yellow, cyan, magenta, and black successively by respective steps of charging, exposure, development, and transfer.

The photosensitive drums 1*a* to 1*d* for bearing visual images (toner images) in the respective colors are disposed in the image forming portions Pa to Pd, respectively. In addition, an intermediate transfer belt 8 caused to rotate clockwise in FIG. 1 is provided adjacent to top portions of the respective image forming portions Pa to Pd in parallel. The toner images formed on those photosensitive drums 1*a* to 1*d* are successively transferred onto the intermediate transfer belt 8 moving in abutment with the respective photosensitive drums 1*a* to 1*d*, and then collectively transferred onto a paper sheet P by a secondary transfer roller 9. After the toner images are fixed to the paper sheet P by the fixing device 7, the paper sheet P is delivered from the apparatus main body. While the photosensitive drums 1*a* to 1*d* are caused to rotate counterclockwise in FIG. 1, image forming processes with respect to the respective photosensitive drums 1*a* to 1*d* are executed.

The paper sheet P onto which a toner image is to be transferred is received in a sheet cassette 16 in a lower portion of the image forming apparatus, and is transported to the secondary transfer roller 9 via a sheet feeding roller 12*a* and a registration roller pair 12*b*. A sheet made of a dielectric resin is used for the intermediate transfer belt 8, and an endless-shape belt both end portions of which are joined to each other with an overlap or a (seamless) belt having no seam are used. The intermediate transfer belt 8 and the secondary transfer roller 9 are driven to rotate by a belt drive motor (not shown) with the same linear velocity as the photosensitive drums 1*a* to 1*d*. Further, a belt cleaning device 19 for removing the toner remaining on a surface of the intermediate transfer belt 8 is located on the upstream side in a moving direction of the intermediate transfer belt 8 when viewed from the image forming portion Pa.

Next described are the image forming portions Pa to Pd. Provided around and below the photosensitive drums 1*a* to 1*d* disposed so as to be free to rotate are: charging devices 2*a*, 2*b*, 2*c*, and 2*d* for charging the photosensitive drums 1*a* to 1*d*; an exposure unit 4 for performing exposure with respect to the respective photosensitive drums 1*a* to 1*d* based on image data; developing units 3*a*, 3*b*, 3*c*, and 3*d* for developing electrostatic latent images, which are formed on the photosensitive drums 1*a* to 1*d*, with toner; and cleaning devices 5*a*, 5*b*, 5*c*, and 5*d* for collecting and removing developers (toner) remaining after the transfer of the toner images from the photosensitive drums 1*a* to 1*d*.

When image data is input from an external device such as a personal computer, the charging devices 2*a* to 2*d* first charge surfaces of the photosensitive drums 1*a* to 1*d* uniformly, and then the exposure unit 4 applies light thereto based on the image data to form electrostatic latent images corresponding to the image data on the respective photosensitive drums 1*a* to 1*d*. The developing units 3*a* to 3*d* include developing rollers (developer carrying member) located so as to be opposed to the photosensitive drums 1*a* to 1*d*. Further, the developing units 3*a* to 3*d* are filled with predetermined amounts of two-component developers containing the respective colors of toner, that is, yellow, cyan, magenta, and black, respectively. Note that, the respective developing units 3*a* to 3*d* are replenished with toner from the respective toner cartridges in a case where the proportion of toner within the two-component developers filling the respective developing units 3*a* to 3*d* falls below a preset value because of formation of the toner image described later.

The toner within the developing units 3*a* to 3*d* is supplied onto the photosensitive drums 1*a* to 1*d* by the developing rollers, and electrostatically adheres thereto. Thus formed are the toner images corresponding to the electrostatic latent images formed by the exposure of the exposure unit 4.

By applying a predetermined transfer voltage to primary transfer rollers 6*a* to 6*d*, the toner images in yellow, cyan, magenta, and black, respectively, on the photosensitive drums 1*a* to 1*d* are primarily transferred onto the intermediate transfer belt 8. The toner images in four colors are formed to have a predetermined positional relationship that is previously defined for forming a predetermined full-color image. The primary transfer rollers 6*a* to 6*d* are driven to rotate by primary transfer drive motors (not shown) with the same linear velocity as the photosensitive drums 1*a* to 1*d* and the intermediate transfer belt 8. After that, in preparation for the formation of new electrostatic latent images to be subsequently performed, the toner remaining on the surfaces of the photosensitive drums 1*a* to 1*d* are removed by the cleaning devices 5*a* to 5*d*, respectively.

The intermediate transfer belt 8 is stretched around a driven roller 10, a drive roller 11, and a tension roller 20. When the intermediate transfer belt 8 starts to rotate clockwise in accordance with the rotation of the drive roller 11 caused by the above-mentioned belt drive motor, the paper sheet P is transported from the registration roller pair 12*b* at a predetermined timing to a nip portion (secondary transfer nip portion) between the secondary transfer roller 9 provided adjacent to the intermediate transfer belt 8 and the intermediate transfer belt 8, and a full-color image is secondarily transferred onto the paper sheet P at the nip portion. The paper sheet P onto which the toner image has been transferred is transported to the fixing device 7.

The paper sheet P transported to the fixing device 7 is heated and pressurized when passing through a nip portion (fixation nip portion) between a fixing roller pair 13, and the toner images are fixed to a surface of the paper sheet P to form a predetermined full-color image thereon. The paper sheet P on which the full-color image has been formed is directed toward one of a plurality of transporting directions branched from a branch portion 14. In a case where an image is formed on only one surface of the paper sheet P, the paper sheet P is delivered to a delivery tray 17 by delivery rollers 15 as it is.

On the other hand, in a case where an image is formed on both surfaces of the paper sheet P, a part of the paper sheet P that has passed through the fixing device 7 is temporarily caused to protrude from the delivery rollers 15 to an external portion of the image forming apparatus. After that, the paper sheet P is directed toward a sheet transport path 18 at the branch portion 14 by reverse rotation of the delivery rollers 15, and is again transported to the secondary transfer roller 9 with an image surface being reversed. Then, the next image formed on the intermediate transfer belt 8 is transferred onto a surface of the paper sheet P on which no image is formed by the secondary transfer roller 9, is transported to the fixing device 7, has the toner images fixed thereto, and is delivered to the delivery tray 17.

A density detecting sensor 35 is located on the downstream side of the image forming portion Pd and immediately on the upstream side of the secondary transfer roller 9. The density detecting sensor 35 applies measurement light to reference images formed on the intermediate transfer belt 8 by the image forming portions Pa to Pd, and detects a reflected light amount from the reference images. A detection result is transmitted to a control portion (not shown) as a light-receiving output signal. Generally used as the density detecting sensor 35 is an optical sensor including a light-emitting element formed of an LED or the like and a light-receiving element formed of a photodiode or the like. In a case of measuring the density of the reference image, the measurement light is successively applied from the light-emitting element to the reference image on the intermediate transfer belt 8, and the measurement light enters the light-receiving element as light reflected by the toner and light reflected by a belt surface.

When an adhesion amount of the toner is large, the reflected light from the belt surface is blocked by the toner, to thereby reduce the light-receiving amount of the light-receiving element. On the other hand, when the toner adhesion amount of the toner is small, the reflected light from the belt surface becomes large, with the result that the light-receiving amount of the light-receiving element increases. Therefore, toner adhesion amounts (image densities) of the reference images in the respective colors are detected by an output value of a light-receiving signal based on the reflected light amount that is received, and characteristic values of an exposure amount and a developing bias are adjusted in comparison with a preset reference density, thereby performing density correction for the respective colors.

The density detecting sensor 35 needs to strictly specify a distance from the reference image being a measurement subject, and as illustrated in FIG. 1, is therefore located in such a position so as to be opposed to the drive roller 11 which exhibits little change in the distance from the surface of the intermediate transfer belt 8.

Note that, the density detecting sensor 35 may be located in another position that allows detection of the reference images on the intermediate transfer belt 8, but in a case where, for example, the density detecting sensor 35 is located on the downstream side of the secondary transfer roller 9, a long time is taken after the reference images are formed by the image forming portions Pa to Pd until the densities are detected, and there is also a fear that a surface state of the reference image may be changed when the reference image is brought into contact with the secondary transfer roller 9. Hence, as illustrated in FIG. 1, it is preferred that the density detecting sensor 35 be located on the downstream side of the image forming portion Pd and on the upstream side of a contact position of the secondary transfer roller 9 with reference to the moving direction of the intermediate transfer belt 8.

(2. Regarding Details of Image Forming Portion)

Next described are details of the image forming portion Pa described above. Note that, the image forming portions Pb to Pd basically have the same structure as the image forming portion Pa, and hence detailed description thereof is omitted.

Figure 2:
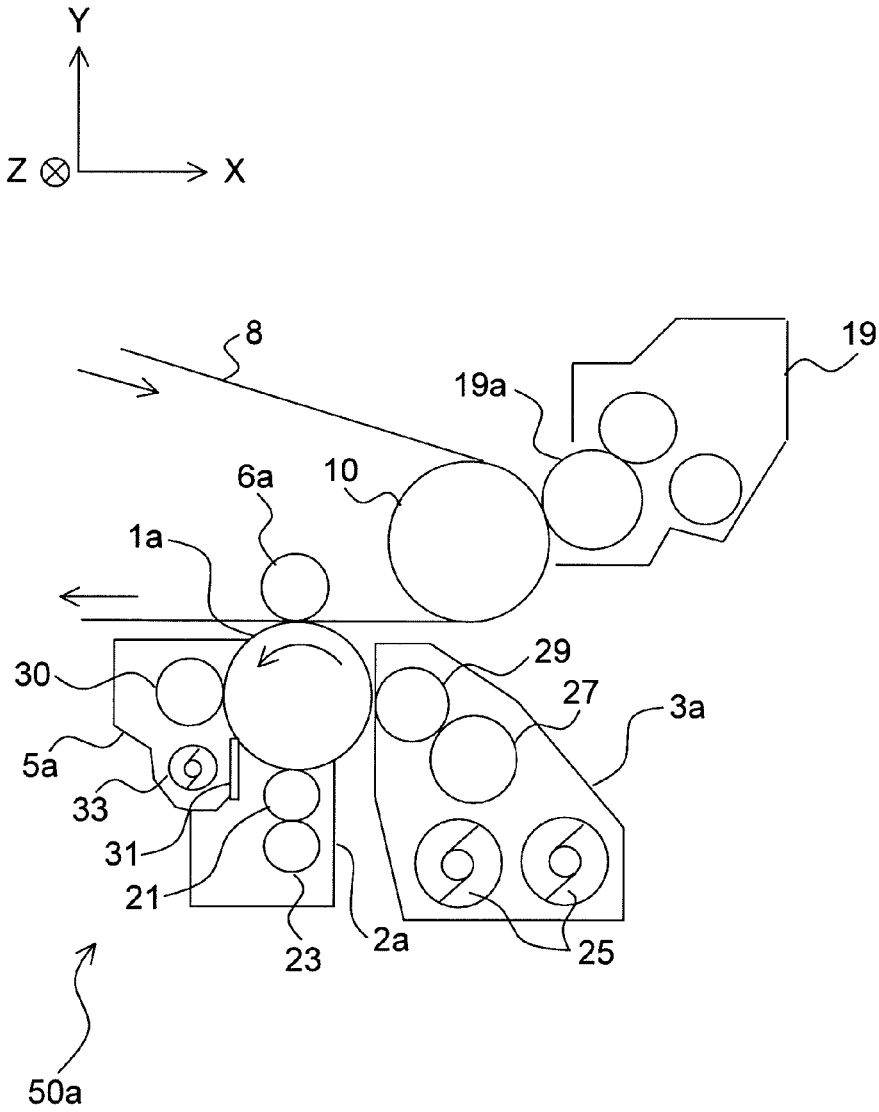
FIG. 2 is an enlarged sectional view illustrating a vicinity of an image forming portion of the image forming apparatus of FIG. 1.

FIG. 2 is an enlarged sectional view illustrating a vicinity of the image forming portion Pa of FIG. 1. Disposed around the photosensitive drum 1*a* along a drum rotation direction (counterclockwise in FIG. 2) are the charging device 2*a*, the developing unit 3*a*, the primary transfer roller 6*a*, and the cleaning device 5*a* that are described above. Of those, the primary transfer roller 6*a* is located in a position opposed to the photosensitive drum 1*a* across the intermediate transfer belt 8.

Further, the photosensitive drum 1*a*, the charging device 2*a*, and the cleaning device 5*a* are formed into a unit. Note that, in the image forming portions Pa to Pd, units each formed of the photosensitive drum, the charging device, and the cleaning device are hereinafter referred to as "process units 50*a* to 50*d*" (see FIG. 5A, FIG. 6, and the like), respectively.

In addition, the belt cleaning device 19 including a brush roller 19*a* is located on the upstream side of the photosensitive drum 1*a* in a rotation direction of the intermediate transfer belt 8 so as to be opposed to the driven roller 10 across the intermediate transfer belt 8. The brush roller 19*a* is driven to rotate in the same direction (forward rotation) on an abutment surface with the intermediate transfer belt 8 with the linear velocity faster than (here, 1.2 times as fast as) the linear velocity of the intermediate transfer belt 8.

The charging device 2*a* includes a charging roller 21 for applying a charging bias to a drum surface in contact with the photosensitive drum 1*a* and a charge cleaning roller 23 for cleaning the charging roller 21. The developing unit 3*a* is of a touch-down developing method, including two stirring-conveyance screws 25, a magnetic roller 27, and a developing roller 29, and applies a developing bias having the same (positive) polarity as a charging polarity of the toner to the developing roller 29 to cause the toner to adsorb to the drum surface.

The cleaning device 5*a* includes a rubbing roller (polishing member) 30, a cleaning blade 31, and a collection spiral 33. The rubbing roller 30 is in press contact with the photosensitive drum 1*a* at a predetermined pressure, and is driven to rotate in the same direction on the abutment surface with the photosensitive drum 1*a* by a color drum cleaning motor (not shown) while the linear velocity is controlled to be faster than (here, 1.2 times as fast as) the linear velocity of the photosensitive drum 1*a*. The rubbing roller 30 has, for example, a structure in which a foam layer made of EPDM rubber with an Asker C hardness 55° is formed as a roller body around a metal shaft. A material of the roller body is not limited to the EPDM rubber and may be rubber of another material or a foam rubber body, and a material having an Asker C hardness within a range of 10° to 90° is suitably used.

Note that, the Asker C is a measurement device for measuring a hardness, and is one of durometers (spring-type hardness tester) defined in The Society of Rubber Industry, Japan Standard. The Asker C hardness represents a hardness measured by the above-mentioned measurement device, indicating a harder material with a larger value thereof.

The cleaning blade 31 is fixed in a state of being in abutment with the photosensitive drum 1*a* on the downstream side in the rotation direction of the abutment surface with the rubbing roller 30 on a surface of the photosensitive drum 1*a*. As the cleaning blade 31, for example, a blade made of polyurethane rubber having a JIS hardness of 78° is used, and is mounted to an abutment point thereof at a predetermined angle with respect to a photosensitive member tangential direction. Note that, a material, a hardness, dimensions, a sinking amount into the photosensitive drum 1*a*, a press-contact force, and the like of the cleaning blade 31 are appropriately set in accordance with specifications of the photosensitive drum 1*a*. Note that, the JIS hardness represents a hardness defined in Japanese Industrial Standards (JIS).

The residual toner removed from the surface of the photosensitive drum 1*a* by the rubbing roller 30 and the cleaning blade 31 is discharged to an external portion of the cleaning device 5*a* (see FIG. 2) in accordance with the rotation of the collection spiral 33. Used as the toner in the present invention is one having an abrasive selected from the group consisting of silica, titanium oxide, strontium titanate, alumina, and the like embedded in a surface of a particle and held so as to partially protrude from the surface or one having the abrasive electrostatically adhere to the surface of the toner.

The rubbing roller 30 is thus caused to rotate with a velocity difference from the photosensitive drum 1*a*, thereby polishing the surface of the photosensitive drum 1*a* by the residual toner containing the abrasive and removing a moisture content and a contaminant from the drum surface together with the residual toner by the rubbing roller 30 and the cleaning blade 31.

Note that, an internal layout of the apparatus main body can be appropriately changed. For example, it is naturally possible to reverse the rotation directions of the photosensitive drums 1*a* to 1*d* and the intermediate transfer belt 8 in this embodiment and the positional relationships between the process units 50*a* to 50*d* and the developing units 3*a* to 3*d*, respectively, in this embodiment and to set a transport path of the paper sheet P in accordance therewith.

Figure 3:
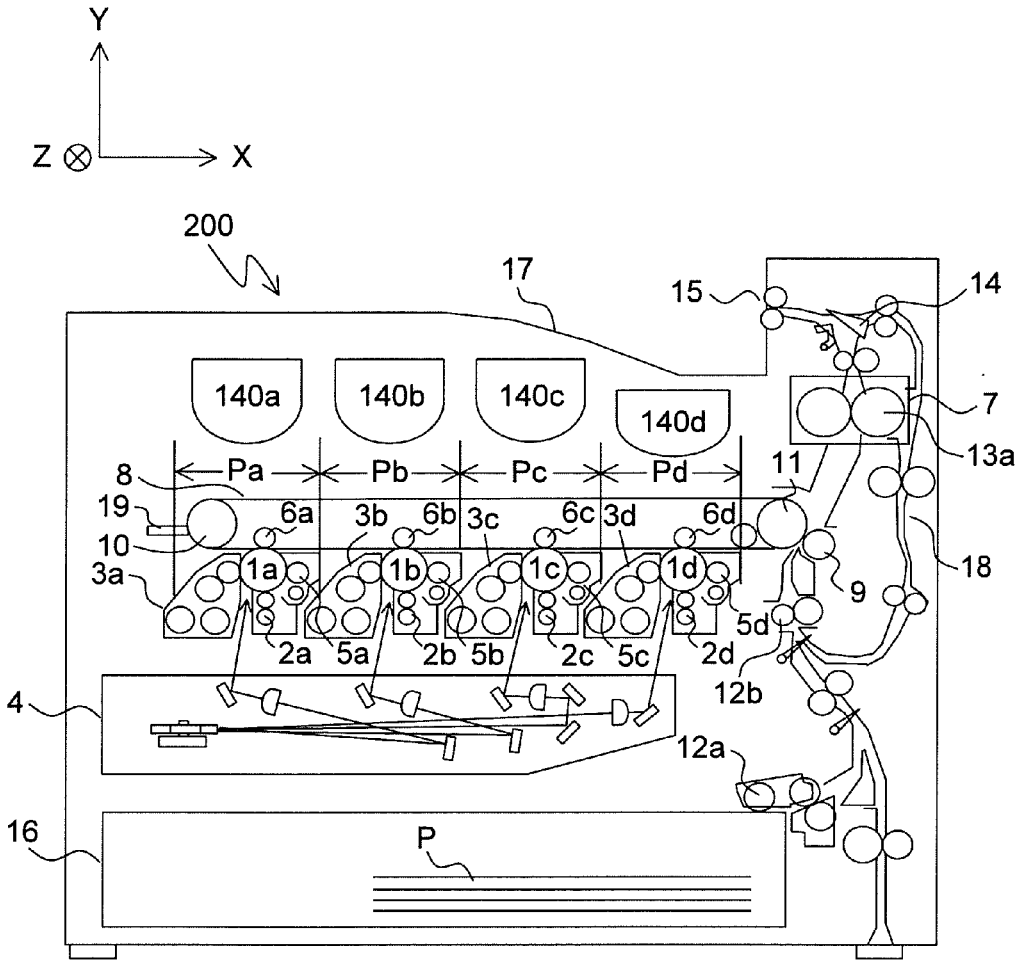
FIG. 3 is a sectional view illustrating another structure of the above-mentioned image forming apparatus.
Figure 4:
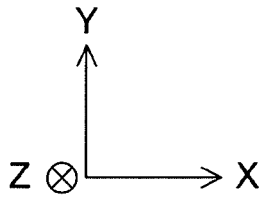
FIG. 4 is an enlarged sectional view illustrating a vicinity of an image forming portion of the image forming apparatus of FIG. 3.
Figure 4:
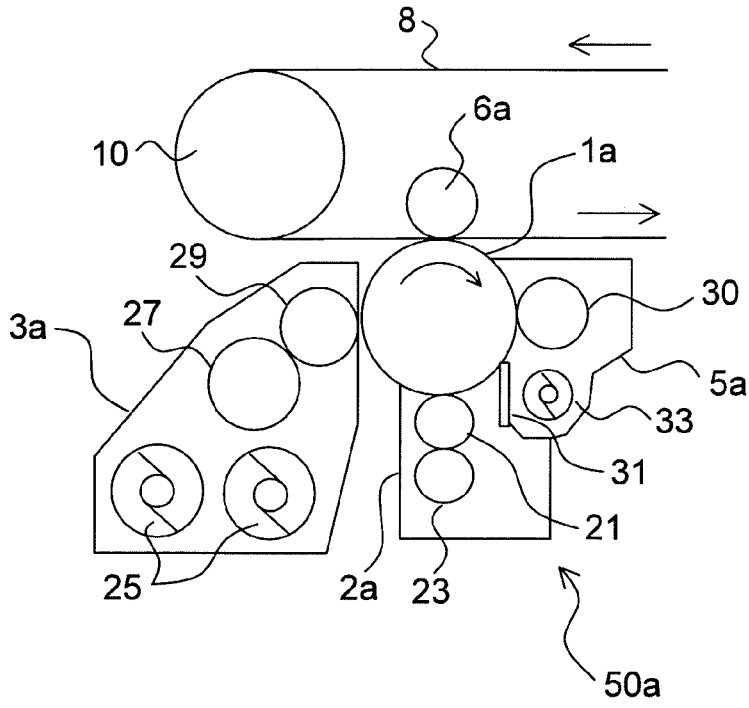

For example, FIG. 3 is a sectional view illustrating another structure of the image forming apparatus 200, and FIG. 4 is an enlarged sectional view illustrating a vicinity of the image forming portion Pa of FIG. 3. The image forming apparatus 200 of FIG. 3 has substantially the same structure as the mirror-reversed structure of the image forming apparatus 200 of FIG. 1, sharing the basic structure therewith. Note that, FIG. 3 additionally shows toner cartridges 140*a* to 140*d* filled with toner to be supplied to the developing units 3*a* to 3*d*, respectively.

In the structure of FIG. 3, the intermediate transfer belt 8 that rotate counterclockwise are provided adjacent to the respective image forming portions Pa to Pd, and the image forming processes with respect to the respective photosensitive drums 1*a* to 1*d* are executed in the same manner as in the case of the structure of FIG. 1 while the photosensitive drums 1*a* to 1*d* are caused to rotate clockwise. Note that, in the structure of FIG. 3, a blade-shape belt cleaner is used as the belt cleaning device 19. Further, the intermediate transfer belt 8 is stretched around the driven roller 10 and the drive roller 11, but as in FIG. 1, may have such a structure as to be stretched also around the tension roller 20.

Figure 5A:
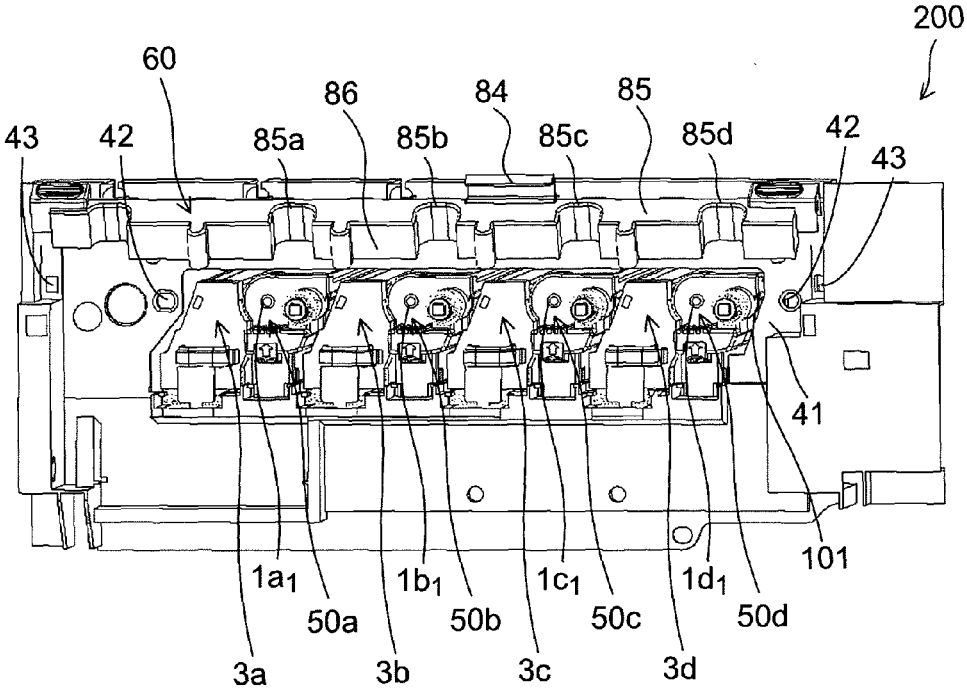
Figure 5B:
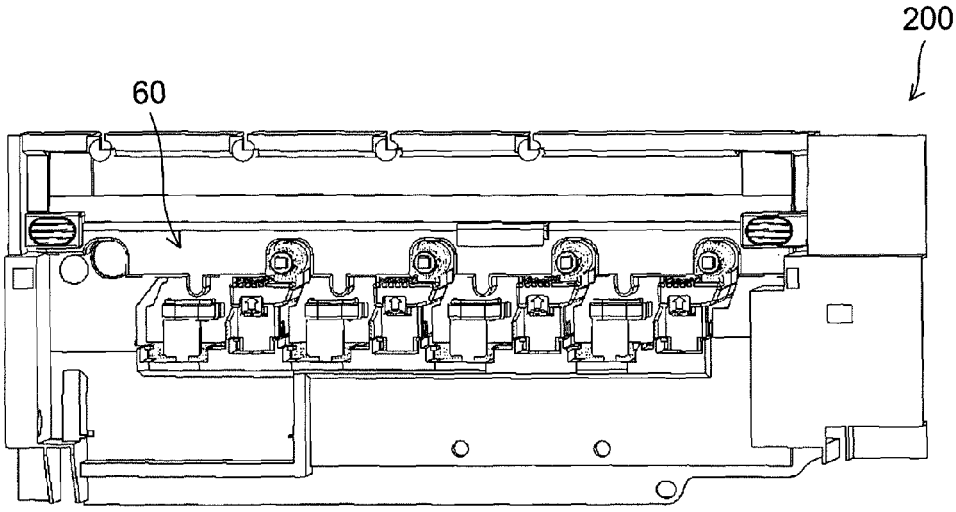

FIG. 5A and FIG. 5B are perspective views of the image forming apparatus 200 of FIG. 3, in which FIG. 5A is a perspective view illustrating a state of the process units 50*a* to 50*d* before being positioned by a positioning device 60 described later and FIG. 5B is a perspective view illustrating a state of the process units 50*a* to 50*d* after being positioned. As illustrated in FIG. 5A and FIG. 5B, the process units 50*a* to 50*d* and the developing units 3*a* to 3*d* are each attached by being slid through an opening portion 101 of the apparatus main body in an axial direction of the photosensitive drum. Then, one end portions of the process units 50*a* to 50*d* on a side of the opening portion 101 are positioned by the positioning device 60. The other end portions of the process units 50*a* to 50*d* are positioned so as to be coupled to drive means (not shown) provided to the apparatus main body on a depth side of the opening portion.

Figure 6:
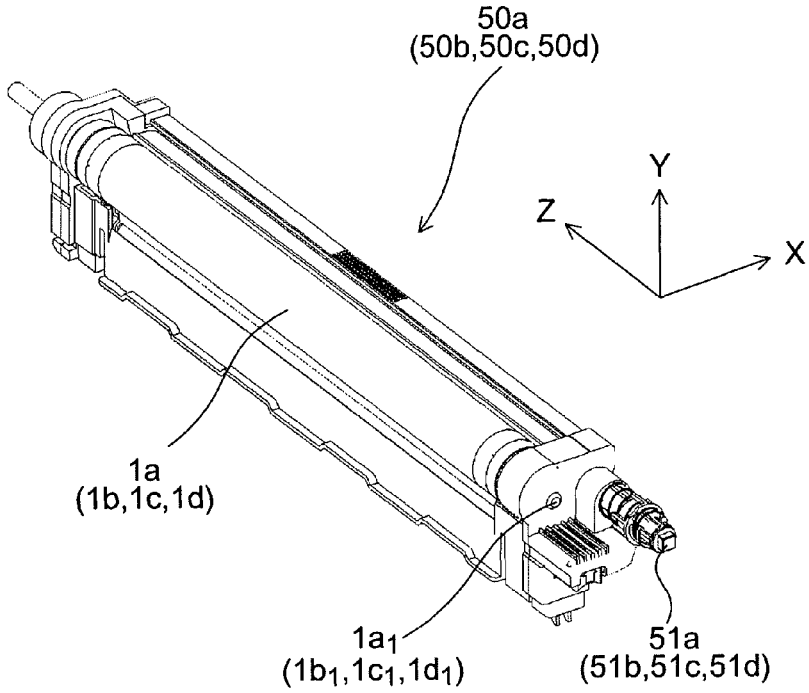
FIG. 6 is a perspective view illustrating an external appearance of the process unit positioned by the above-mentioned process unit positioning device.

Here, description is added to the process units 50*a* to 50*d* to be subjected to the positioning by the positioning device 60. FIG. 6 is a perspective view illustrating an external appearance of the process unit 50*a* to be subjected to the positioning by the positioning device 60. The process unit 50*a* includes a waste toner outlet 51*a* in addition to the photosensitive drum 1*a*, the charging device 2*a*, and the cleaning device 5*a* that are described above. The toner for disposal collected by the cleaning device 5*a* is discharged from the waste toner outlet 51*a* and conveyed to the collection container 120 (see FIG. 18) via a waste toner conveying device 110 (see FIG. 17) described later. Further, in the same manner, the process units 50*b* to 50*d* also include waste toner outlets 51*b* to 51*d*, respectively, and the toner for disposal collected by the cleaning devices 5*b* to 5*d* are discharged from the waste toner outlets 51*b* to 51*d*, respectively, and conveyed to the collection container 120 via the waste toner conveying device 110.

Figure 7:
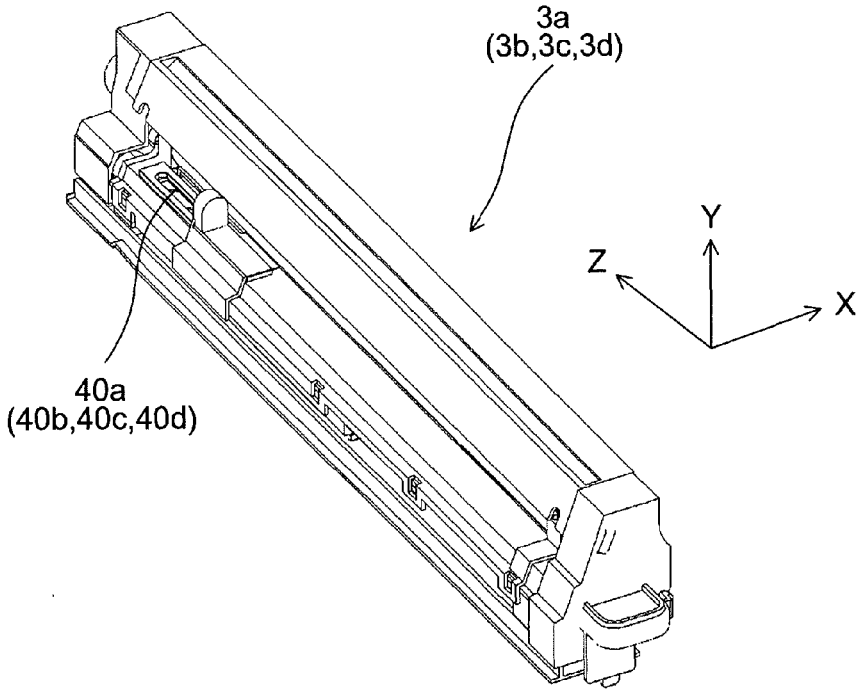
FIG. 7 is a perspective view illustrating an external appearance of a developing unit used along with the above-mentioned process unit.

Further, FIG. 7 is a perspective view illustrating an external appearance of the developing unit 3*a* used along with the above-mentioned process unit 50*a*. The developing unit 3*a* includes therein the two stirring-conveyance screws 25, the magnetic roller 27, and the developing roller 29 that are described above, and further includes a toner supply port 40*a* to be connected to a toner supply portion 130*a* described later (see FIG. 23). The toner in the corresponding color is supplied to an internal portion of the developing unit 3*a* via the toner supply port 40*a* and used for development of the electrostatic latent image. Further, in the same manner, the developing units 3*b* to 3*d* include toner supply ports 40*b* to 40*d*, respectively, and the toner in the corresponding colors is supplied to internal portions of the developing units 3*b* to 3*d* via the toner supply ports 40*b* to 40*d*, respectively, and used for development of the electrostatic latent images.

(3. Regarding Process Unit Positioning Device)

Next described is the process unit positioning device according to the present invention. Note that, for convenience in the following description, directions are defined as follows. First, in the above-mentioned image forming apparatus 200, a direction in which the drum shafts of the photosensitive drums 1*a* to 1*d* are arrayed is set as an X direction, a direction perpendicular to a plane including axes of the respective drum shafts is set as a Y direction, and a direction (drum shaft direction) perpendicular to the X direction and the Y direction is set as a Z direction. That is, in the image forming apparatus 200 of FIG. 3 and the like, the X direction corresponds to a horizontal direction, the Y direction corresponds to a vertical direction, and the Z direction corresponds to a front-to-back direction. Note that, each of the X, Y, and Z directions indicates a direction in a state in which positioning has been completed by the process unit positioning device (hereinafter, referred also to as "positioned state"). Note that, it is irrelevant whether each of the X, Y, and Z directions is positive or negative.

Figure 8:
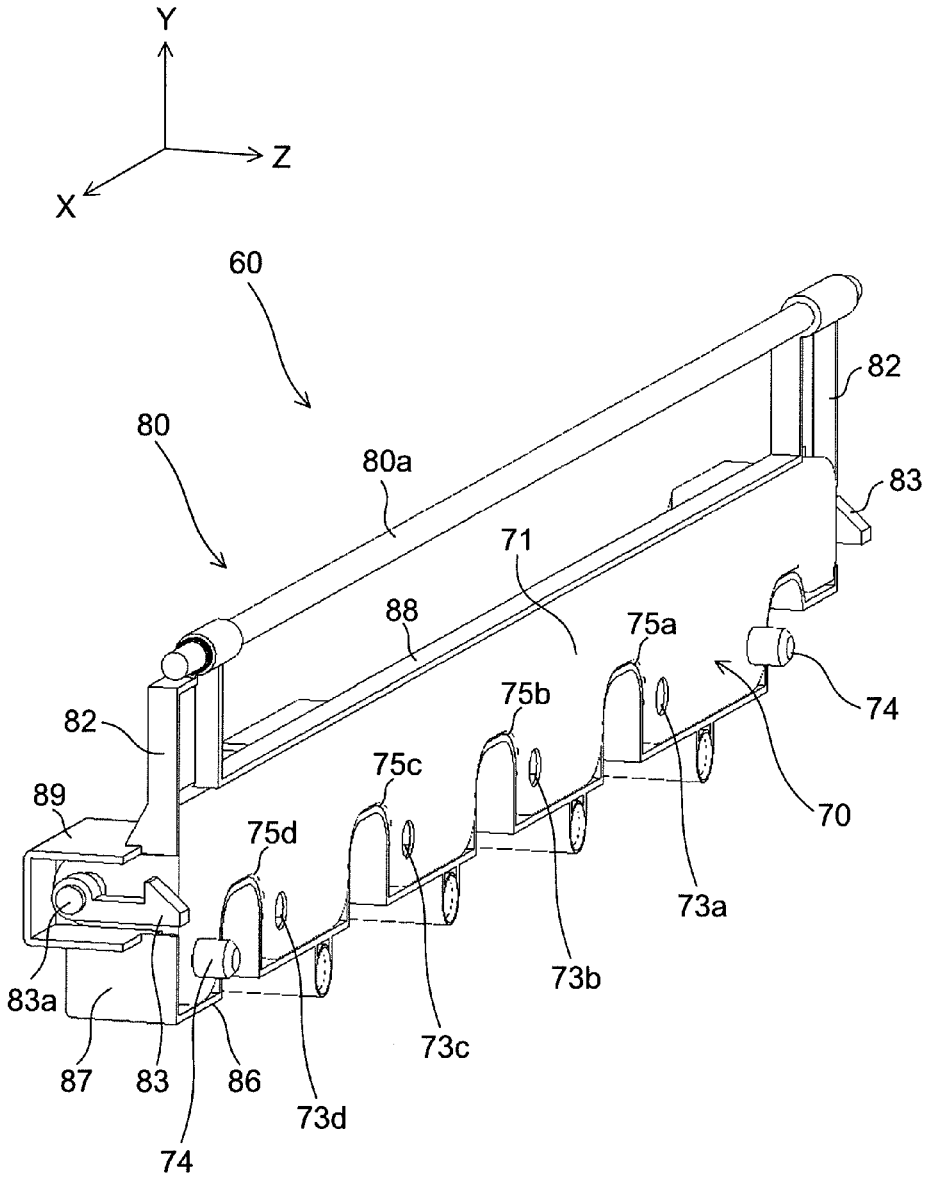
FIG. 8 is a perspective view illustrating a schematic structure of the above-mentioned process unit positioning device.

FIG. 8 is a perspective view illustrating a schematic structure of the positioning device 60. The positioning device 60 is a process unit positioning device for performing mutual positioning of the process units 50*a* to 50*d* individually including the photosensitive drums 1*a* to 1*d*, respectively. The positioning device 60 includes a positioning plate 70, the holder portion 80, and a coil spring 90 (see FIG. 10). Hereinafter, structures of the respective components are described in detail.

(3-1. Positioning Plate)

Figure 9:
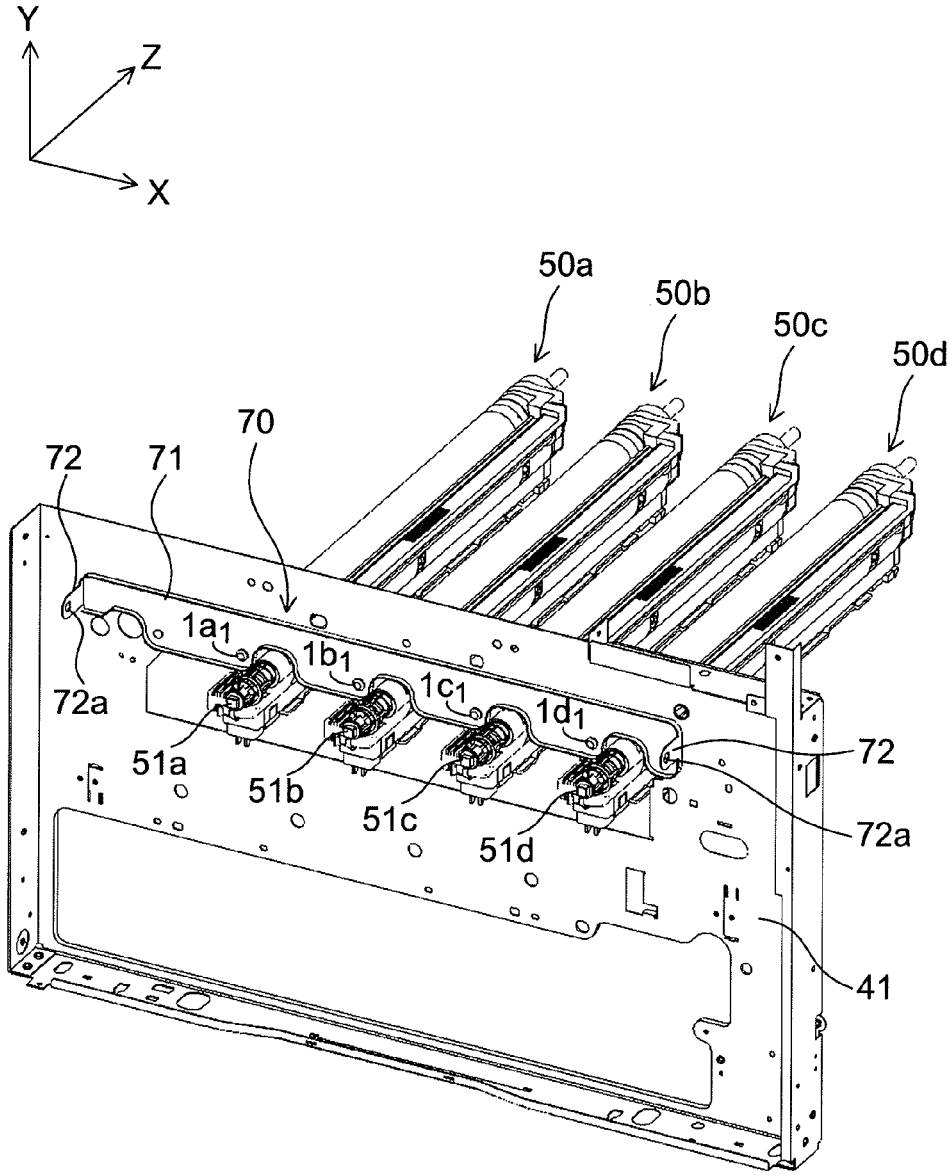
FIG. 9 is a perspective view of a positioning plate of the above-mentioned process unit positioning device in a positioned state.
Figure 10:
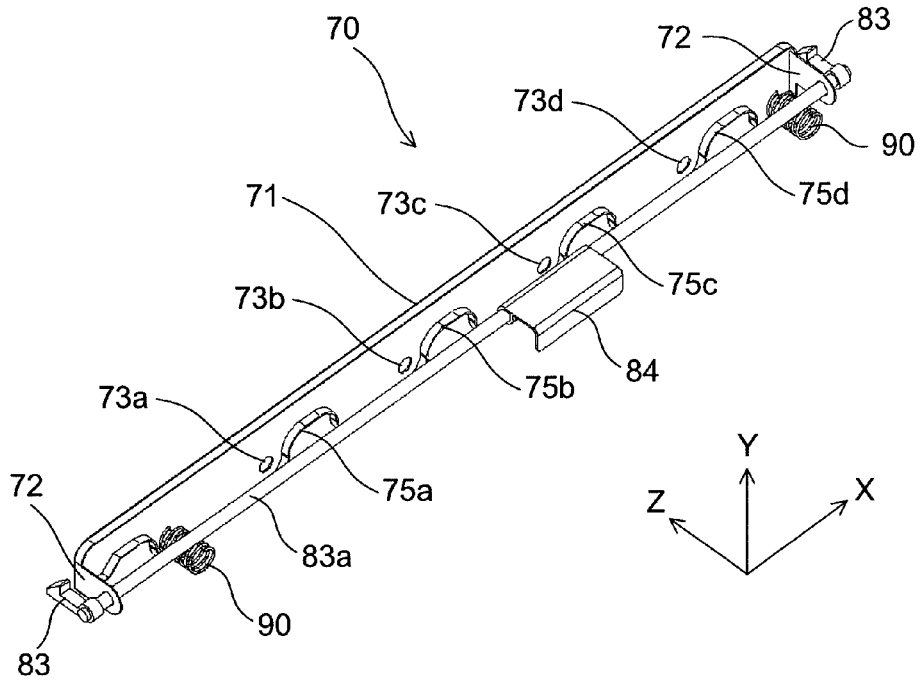
FIG. 10 is a perspective view of a state in which a pivot shaft between hooks of a holder portion of the above-mentioned process unit positioning device is inserted through the above-mentioned positioning plate.

FIG. 9 is a perspective view of the positioning plate 70 in the positioned state, and FIG. 10 is a perspective view of a state in which a pivot shaft 83*a* between hooks 83 described later of the holder portion 80 of the above-mentioned process unit positioning device is inserted through the positioning plate 70. The positioning plate 70 is a sheet metal member having a structure including a flat plate portion 71 and insertion portions 72/72.

As illustrated in FIG. 8, the flat plate portion 71 is a plate-like flat plate in which bearing holes 73*a*, 73*b*, 73*c*, and 73*d*, positioning pins 74/74 (positioning portions), and concave portions 75*a*, 75*b*, 75*c*, and 75*d* are formed. In the flat plate portion 71, the bearing holes 73*a* to 73*d* are formed in a row at predetermined intervals in the X direction and on a lower side than the center in the Y direction. In the flat plate portion 71, the concave portions 75*a* to 75*d* are formed in positions displaced from the bearing holes 73*a*, 73*b*, 73*c*, and 73*d*, respectively, along the X direction. Upon the pivot of the holder portion 80, the waste toner outlets 51*a* to 51*d* (see FIG. 9) of the process units 50*a* to 50*d* pass through the inside of the concave portions 75*a* to 75*d* of the flat plate portion 71, respectively, which avoids interference between the waste toner outlets 51*a* to 51*d* and the flat plate portion 71. The flat plate portion 71 is thus formed to have such a shape as to avoid contact with the waste toner outlets 51*a* to 51*d* of the process units 50*a* to 50*d*, respectively, upon the pivot of the holder portion 80.

The positioning pins 74/74 penetrate the flat plate portion 71 and are fixed to the flat plate portion 71 so that the bearing holes 73*a* to 73*d* and the concave portions 75*a* to 75*d* are located therebetween. Therefore, the positioning pins 74/74 are located in the same straight line as the bearing holes 73*a* to 73*d* in the X direction. Those positioning pins 74/74 are fixed to the flat plate portion 71 by having their back ends swaged to plates 74*a*/74*a* (see FIG. 13A, FIG. 13B). The positioning is performed with respect to the apparatus main body by fitting the positioning pins 74/74 respectively into hole portions 42/42 (see FIG. 5A) for positioning which are formed in a front side plate 41 of the apparatus main body into which the respective process units 50*a* to 50*d* are loaded.

The insertion portions 72/72 are formed by bending both end portions in the X direction of the flat plate portion 71 toward an opposite side to a contact side with the front side plate 41 (see FIG. 9). Therefore, the two insertion portions 72/72 have a positional relationship of being opposed to each other across the flat plate portion 71.

Figure 11:
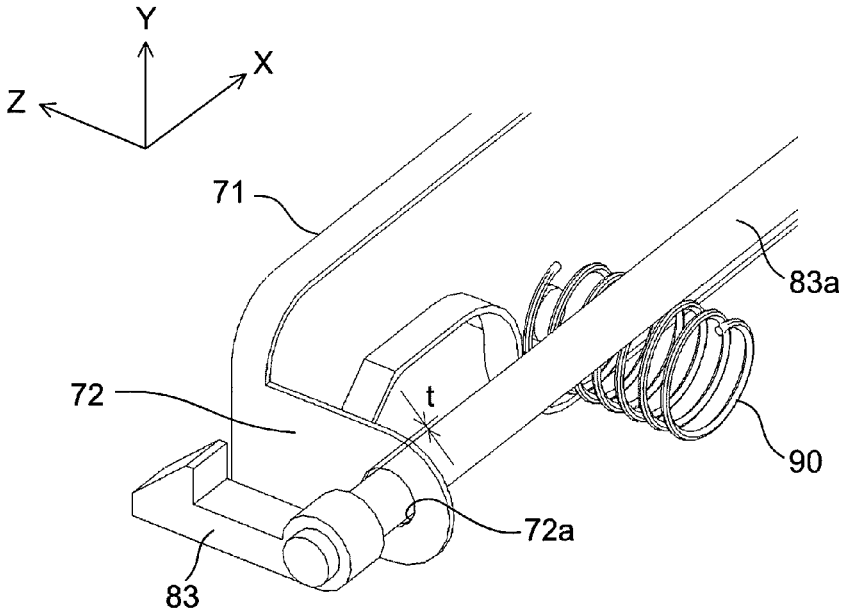
FIG. 11 is an enlarged perspective view illustrating an insertion portion of the above-mentioned positioning plate through which the pivot shaft between the hooks is inserted.

The insertion ports 72*a*/72*a* are formed in the insertion portions 72/72. Here, FIG. 11 is an enlarged perspective view illustrating one of the insertion portions 72. The pivot shaft 83*a* between the hooks 83/83 of the holder portion 80 is inserted through the insertion port 72*a* with a slight clearance t (mm). Note that, the same applies to the other insertion portion 72. An average of the above-mentioned clearance t is ((inner diameter of insertion port 72*a*)−(outer diameter of pivot shaft 83*a*))/2.

In other words, in a case where the pivot shaft 83*a* is inserted through the insertion port 72*a* with the clearance, the even clearance t is not created between an external surface of the pivot shaft 83*a* and an internal surface of the insertion port 72*a*, and the insertion portion 72 is held by the pivot shaft 83*a* with the pivot shaft 83*a* being located in a position relatively displaced from the center of the insertion port 72*a* in a radius direction of the insertion port 72*a* and being brought into contact with the internal surface of the insertion port 72*a*. Therefore, a minimum value of the above-mentioned clearance t is 0 (value at a contact point), and a maximum value thereof is (internal diameter of insertion port 72*a*)−(outer diameter of pivot shaft 83*a*). Thus, the average of the clearance t is ((inner diameter of insertion port 72*a*)−(outer diameter of pivot shaft 83*a*))/2.

As described above, the clearance t exists between the internal surface of the insertion port 72*a* and the external surface of the pivot shaft 83*a*, and hence the positioning plate 70 (in particular, flat plate portion 71) is held by the holder portion 80 (in particular, pivot shaft 83*a*) so as to allow a displacement to some extent. In other words, the positioning plate 70 is not completely fixed to the holder portion 80 but held thereby so as to allow a wobble to occur to some extent. Note that, the displacement of the flat plate portion 71 includes a parallel move of the flat plate portion 71 toward a direction perpendicular to the pivot shaft 83*a* and a change in inclination of the flat plate portion 71 with the pivot shaft 83*a* set as a rocking axis.

Note that, the insertion portions 72/72 may be structured as separate members from the flat plate portion 71 and structured so as to be fixed to the both end portions in the X direction of the flat plate portion 71. In short, the insertion portions 72/72 may have any structure as long as the insertion portions 72/72 are erected on the flat plate portion 71 in the Z direction at the both end portions in the X direction.

(3-2. Holder Portion)

Figure 12:
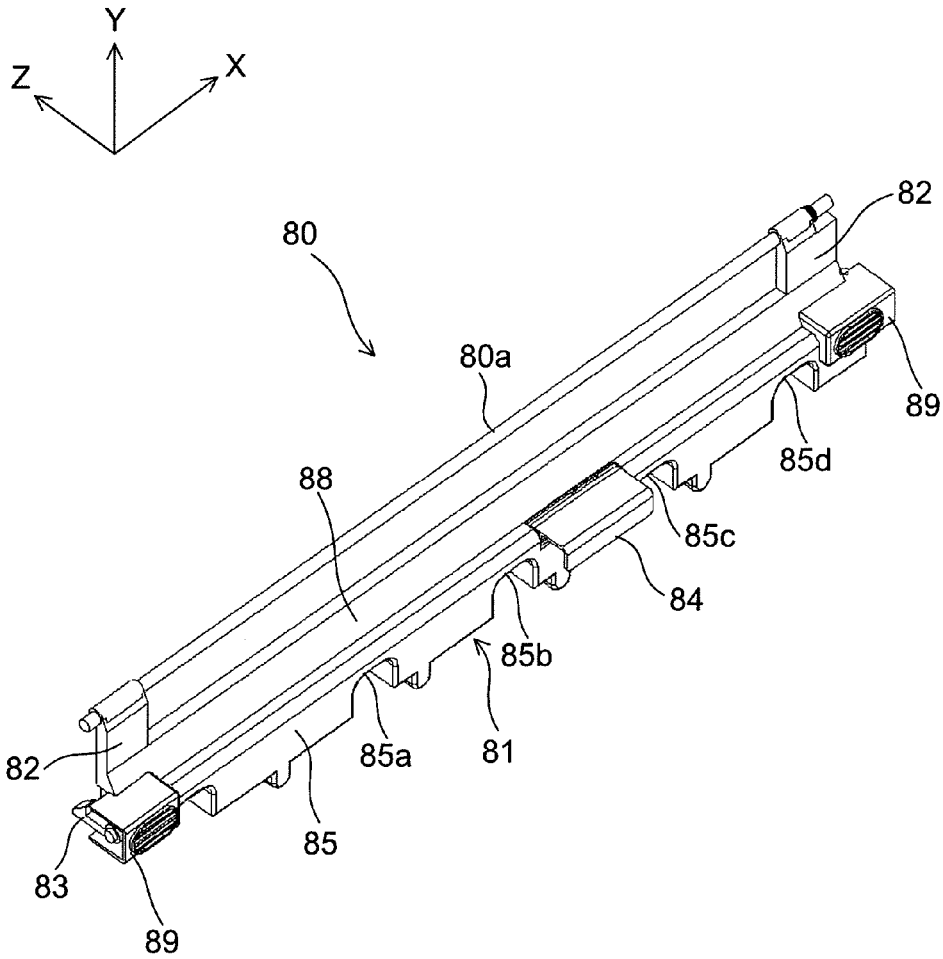
FIG. 12 is a perspective view illustrating a schematic structure of the above-mentioned holder portion.
Figure 13B:
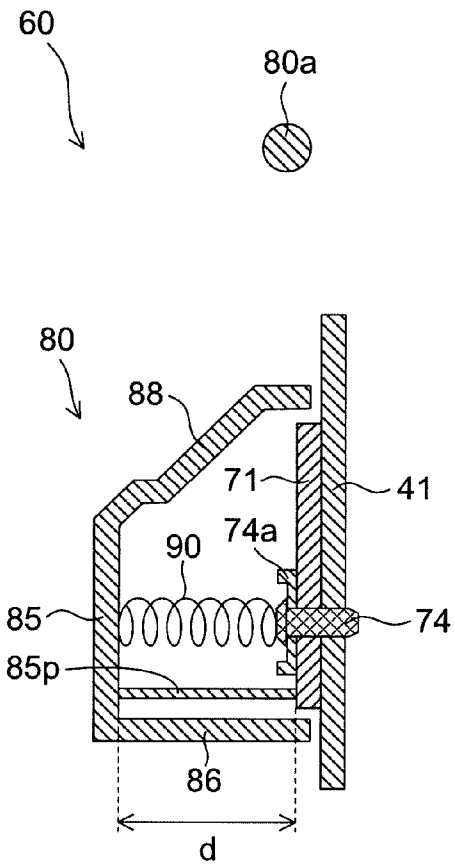
Figure 13A:
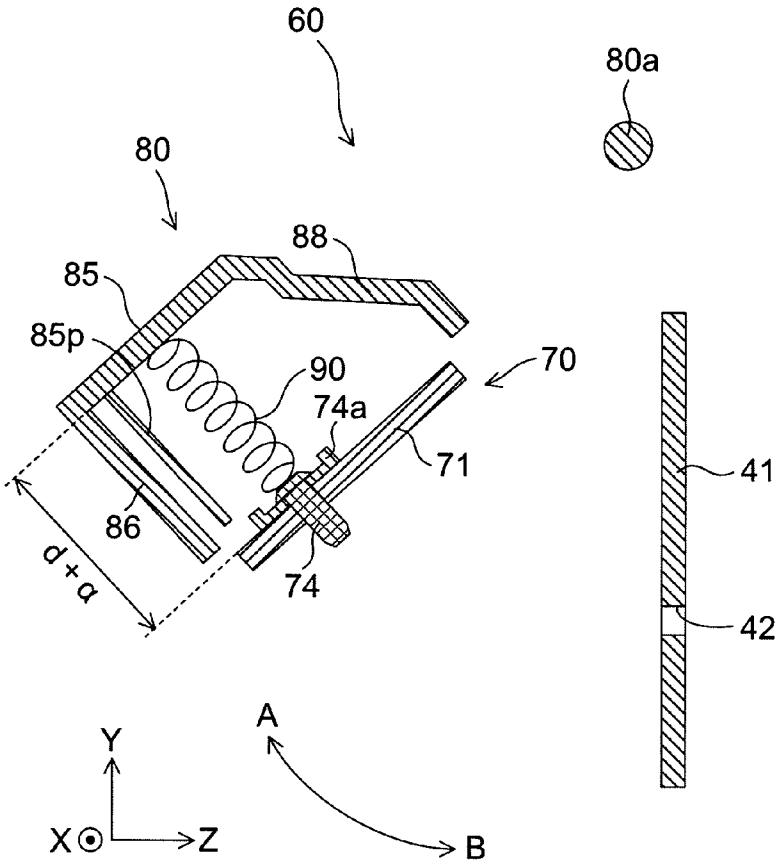

Next, the holder portion 80 is described with reference to FIG. 8, FIG. 12, FIG. 13A, and FIG. 13B. FIG. 12 is a perspective view illustrating a schematic structure of the holder portion 80. Further, FIG. 13A and FIG. 13B are sectional views illustrating a schematic structure of the positioning device 60, in which FIG. 13A is a sectional view illustrating an unpositioned state and FIG. 13B is a sectional view illustrating the positioned state.

The holder portion 80 is a holding member for relatively inserting/removing drum shafts $\mathbf{1}a_1$, $\mathbf{1}b_1$, $\mathbf{1}c_1$, and $\mathbf{1}d_1$ into/from the bearing holes 73*a*, 73*b*, 73*c*, and 73*d*, respectively, of the positioning plate 70 by pivoting about a pivot shaft 80*a* while holding the positioning plate 70. The holder portion 80 is supported by couple portions 82/82 coupling the both end portions of the pivot shaft 80*a* to a main unit 81. The main unit 81 supports the pivot shaft 83*a* that holds the positioning plate 70, the hooks 83/83, and a lever 84.

The pivot shaft 80*a* is located in parallel with the X direction in which the drum shafts $\mathbf{1}a_1$ to $\mathbf{1}d_1$ of the process units 50*a* to 50*d*, respectively, are arrayed, and is supported by the apparatus main body so as to be located above the drum shafts $\mathbf{1}a_1$ to $\mathbf{1}d_1$. That is, in FIG. 8, the pivot shaft 80*a* is located above the bearing holes 73*a* to 73*d*, into which the drum shafts $\mathbf{1}a_1$ to $\mathbf{1}d_1$, respectively, are fitted, in the Y direction. Therefore, the positioning device 60 can pivot with the pivot shaft 80*a* as a fulcrum so as to be opened from a lower side of the front surface of the apparatus main body.

The main unit 81 is long in the X direction as a whole, and a shape thereof obtained when sectioned by a plane perpendicular to the pivot shaft 80*a* is such a concave shape as to have an opening on a side facing the front side plate 41 in the positioned state. The flat plate portion 71 of the above-mentioned positioning plate 70 is located in the above-mentioned opening of the main unit 81. However, as described above, the flat plate portion 71 is held by the pivot shaft 83*a* via the insertion portions 72/72 so as to allow a displacement, and is not fixed to the main unit 81. The main unit 81 is located below the pivot shaft 80*a* in the Y direction in the positioned state.

The above-mentioned main unit 81 has a structure including an opposing wall portion 85, a bottom surface portion 86, side surface portions 87/87, a top surface portion 88, and hook protection portions 89/89.

The opposing wall portion 85 is a wall portion opposes the flat plate portion 71 of the positioning plate 70 with a gap. Formed in the opposing wall portion 85 are concave portions 85*a*, 85*b*, 85*c*, and 85*d* corresponding to the concave portions 75*a*, 75*b*, 75*c*, and 75*d* of the flat plate portion 71, respectively. Accordingly, in the positioned state of the holder portion 80, the waste toner outlets 51*a* to 51*d* of the process units 50*a* to 50*d* pass through the inside of the concave portions 85*a* to 85*d*, respectively, of the opposing wall portion 85, which avoids interference between the waste toner outlets 51*a* to 51*d* and the opposing wall portion 85. Further, as illustrated in FIG. 13A and FIG. 13B, a length (height) in the Y direction of the opposing wall portion 85 is smaller than a length (height) in the Y direction of the flat plate portion 71. In addition, an abutment portion 85*p* with which the flat plate portion 71 is brought into abutment in the positioned state is erected on the opposing wall portion 85.

The bottom surface portion 86 is coupled to a lower end portion in the Y direction of the opposing wall portion 85 to thereby form a bottom surface of the main unit 81. Therefore, the bottom surface portion 86 is a flat plate in a site coupled to the opposing wall portion 85 other than the concave portions 85*a* to 85*d*, and has a shape having curved surfaces along the concave portions 85*a* to 85*d* in sites coupled to the concave portions 85*a* to 85*d*.

The side surface portions 87/87 are perpendicularly coupled to the opposing wall portion 85 and the bottom surface portion 86 at both ends thereof in the X direction. The top surface portion 88 is coupled to an upper end portion in the Y direction of the opposing wall portion 85, and has such a shape that a distance from the bottom surface portion 86 widens from the side of the opposing wall portion 85 toward the opening side (side of flat plate portion 71) stepwise or continuously (see FIG. 13A and FIG. 13B). The above-mentioned couple portions 82/82 are respectively provided to both ends in the X direction of the top surface portion 88.

The hook protection portions 89/89 are respectively provided to both the ends in the X direction of the opposing wall portion 85, the side surface portions 87/87, and the top surface portion 88 so as to cover the hooks 83/83 within a plane perpendicular to the pivot shaft 80*a* and so as to extend slightly from the side surface portions 87/87 in the X direction, and protects the hooks 83/83. However, the hook protection portions 89/89 has openings on sides opposed to the front side plate 41 in the positioned state, and tips of the hooks 83/83 are exposed from the openings.

The hooks 83/83 are engagement members that are engaged with hole portions 43/43 (see FIG. 5A) formed in the front side plate 41 of the apparatus main body into which the respective process units 50*a* to 50*d* are loaded. The hooks 83/83 are provided to both ends of the pivot shaft 83*a* supported by the main unit 81, and are integrally caused to pivot with the pivot shaft 83*a* as a fulcrum. The hooks 83/83 are urged by a spring (not shown) toward such a pivot direction as to be engaged with the hole portions 43/43 of the apparatus main body. Note that, the pivot shaft 83*a* between the hooks 83/83 is provided in parallel with the pivot shaft 80*a* of the holder portion 80 (X direction in positioned state).

The lever 84 is fixed to a center portion in the X direction of the pivot shaft 83*a* between the hooks 83/83, and releases the engagement of the hooks 83/83 with the apparatus main body by causing the hooks 83/83 to pivot with the pivot shaft 83*a* as a fulcrum in a direction reverse to such a pivot direction as to be engaged with the apparatus main body.

(3-3. Coil Spring)

Next, the coil spring 90 is described with reference to FIG. 13A and FIG. 13B. The coil spring 90 is a flat plate urging member for urging the flat plate portion 71 in a direction in which the flat plate portion 71 of the positioning plate 70 moves away from the opposing wall portion 85 of the holder portion 80, and is provided between the opposing wall portion 85 and the flat plate portion 71. In particular, the coil spring 90 urges a position displaced from the center of the flat plate portion 71 within the plane perpendicular to the pivot shaft 80*a* of the holder portion 80. Specifically, for example, in the positioned state of FIG. 13B, the coil spring 90 urges a position displaced from the center of the flat plate portion 71 toward the lower side in the Y direction. Further, two coil springs 90 are provided corresponding to the two positioning pins 74/74 (see FIG. 10), and respectively urge the positioning pin 74 along with the plate 74*a* from the back end toward the side of the front side plate 41.

Note that, the urging member is not limited to the above-mentioned coil spring 90 as long as the urging member can urge the flat plate portion 71 in a direction in which the flat plate portion 71 moves away from the opposing wall portion 85, and may be, for example, a leaf spring or a rubber-like elastic body.

(3-4. Regarding Positioning)

Next, the positioning device 60 is referenced to describe an operation for performing the positioning of the respective process units 50*a* to 50*d*. Note that, in the following description, a direction for opening the positioning device 60 apart from the apparatus main body, that is, a direction for causing the positioning device 60 to pivot apart from the apparatus main body so as to expose the respective process units 50*a* to

50*d* is referred to as "A direction", and the reverse direction is referred to as "B direction" (see FIG. 13A).

First, in an initial state before the replacement of the respective process units 50*a* to 50*d*, that is, in a state in which the respective process units 50*a* to 50*d* are loaded into the apparatus main body, as illustrated in FIG. 9, the drum shafts $\mathbf{1}a_1$ to $\mathbf{1}d_1$ of the respective process units 50*a* to 50*d* are fitted into the bearing holes 73*a* to 73*d* (see FIG. 8), respectively, of the flat plate portion 71 of the positioning device 60, and the mutual positioning of the respective process units 50*a* to 50*d* is appropriately performed. Further, the positioning pins 74/74 are fitted into the hole portions 42/42 (see FIG. 5A), respectively, of the front side plate 41 of the apparatus main body, and the positioning of the positioning device 60 with respect to the apparatus main body is appropriately performed. Such a position of the positioning device 60 with respect to the apparatus main body in the initial state is the same as the position in the positioned state described above with reference to FIG. 5B.

At this time, as illustrated in FIG. 13B, the flat plate portion 71 is abutted against a tip of the abutment portion 85*p* erected on the opposing wall portion 85 of the holder portion 80, and a distance between the opposing wall portion 85 and the flat plate portion 71 is maintained at a length d (mm) in the Z direction of the abutment portion 85*p*. Note that, the flat plate portion 71 is urged by the coil spring 90 in such a direction as to move away from the opposing wall portion 85, but movement of the above-mentioned urging direction is restricted by the contact with the front side plate 41 of the apparatus main body.

Next, when the respective process units 50*a* to 50*d* are to be replaced, in order to release the positioning performed by the positioning device 60, a user operates the lever 84 of the holder portion 80 to cause the hooks 83/83 to pivot with the pivot shaft 83*a* as a fulcrum and release the engagement with the apparatus main body (hole portions 43/43 of front side plate 41) realized by the hooks 83/83. Accordingly, by causing the positioning device 60 to pivot in the A direction with the pivot shaft 80*a* of the holder portion 80 as a fulcrum, the user can release the fit of the drum shafts $\mathbf{1}a_1$ to $\mathbf{1}d_1$ into the bearing holes 73*a* to 73*d*, respectively, and the fit of the positioning pins 74/74 into the hole portions 42/42, respectively. As illustrated in FIG. 5A, by causing the positioning device 60 to pivot in the A direction until sides of the drum shafts $\mathbf{1}a_1$ to $\mathbf{1}d_1$ of the respective process units 50*a* to 50*d* are exposed, the user can extract the respective process units 50*a* to 50*d* from the apparatus main body for the replacement.

At this time, the flat plate portion 71 is urged by the coil spring 90 in such a direction as to move away from the opposing wall portion 85, the contact with the front side plate 41 is released, and the restriction of the movement in the above-mentioned urging direction due to the above-mentioned contact is also released. Therefore, as illustrated in FIG. 13A, the distance between the opposing wall portion 85 and the flat plate portion 71 is d+α (mm) and increases compared to the positioned state, and the abutment between the flat plate portion 71 and the abutment portion 85*p* is also released. Note that, α corresponds to a maximum length of the clearance t (twice the average of clearance t) between the insertion port 72*a* and the pivot shaft 83*a*.

Figure 14A:
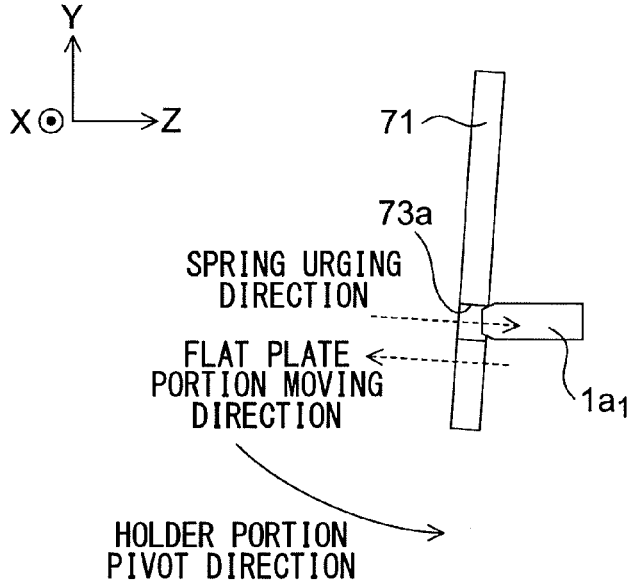
Figure 14B:
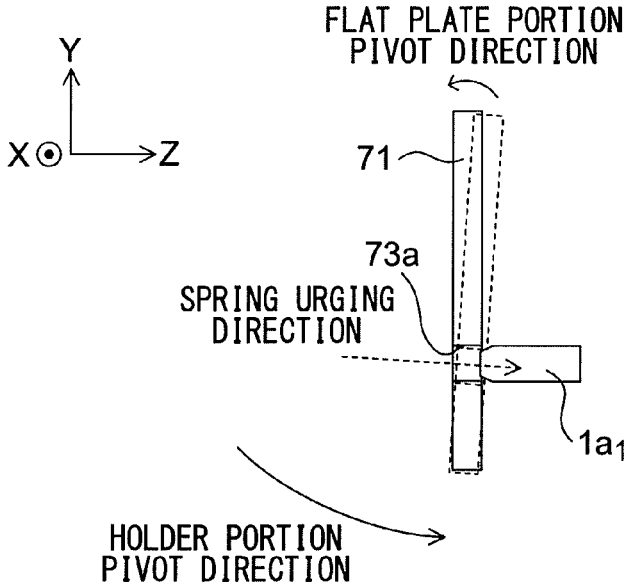

After the replacement of the respective process units 50*a* to 50*d*, the positioning of the respective process units 50*a* to 50*d* is performed by causing the positioning device 60 to pivot in the B direction. Here, FIG. 14A and FIG. 14B illustrate a state in which the tip of the drum shaft $\mathbf{1}a_1$ is brought into contact with the bearing hole 73*a* of the flat plate portion 71 by the pivot of the positioning device 60 in the B direction. The drum shaft $\mathbf{1}a_1$ extends in the Z direction, and hence a fitting direction of the drum shaft $\mathbf{1}a_1$ into the bearing hole 73*a* is also the Z direction. However, the pivot direction of the positioning device 60 lays down an arc-shaped trail within the plane perpendicular to the pivot shaft 80*a*, and is strictly different from the above-mentioned fitting direction. Therefore, frictional resistance and stress caused upon contact make it difficult to fit the drum shaft $\mathbf{1}a_1$ into the bearing hole 73*a*.

However, the flat plate portion 71 is held by the holder portion 80 (pivot shaft 83*a*) via the insertion portions 72/72 in a state that allows a displacement because of the existence of the clearance t, and upon the contact between the bearing hole 73*a* and the drum shaft $\mathbf{1}a_1$, as illustrated in FIG. 14A, the flat plate portion 71 moves in a direction reverse to the above-mentioned urging direction (relatively approaches opposing wall portion 85) against the urging of the coil spring 90, while as illustrated in FIG. 14B, the flat plate portion 71 itself pivots to change the inclination of the flat plate portion 71 to the urging direction. Such movement of the flat plate portion 71, that is, a relative and continuous position change of the flat plate portion 71 with respect to the opposing wall portion 85 alleviates the frictional resistance and stress caused upon contact between the bearing hole 73*a* and the drum shaft $\mathbf{1}a_1$, and facilitates the fit of the drum shaft $\mathbf{1}a_1$ into the bearing hole 73*a*. Note that, the same applies to the fit of the drum shafts $\mathbf{1}b_1$ to $\mathbf{1}d_1$ into the bearing holes 73*b* to 73*d*, respectively.

Figure 15A:
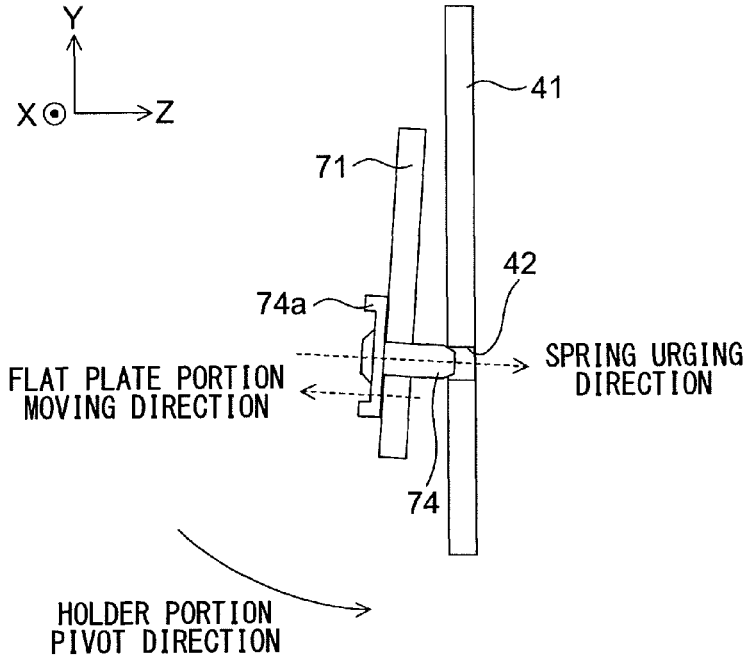
Figure 15B:
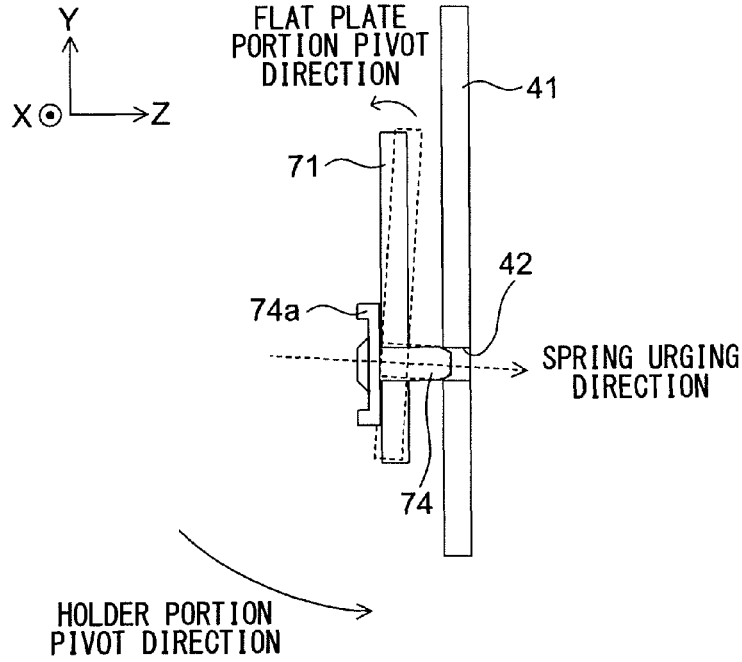

Further, FIG. 15A and FIG. 15B illustrate a state in which the tip of the positioning pin 74 is brought into contact with the hole portion 42 of the front side plate 41 by the pivot of the positioning device 60 in the B direction. The same applies to the fit of the positioning pin 74 into the hole portion 42. That is, upon the contact between the positioning pin 74 and the hole portion 42, as illustrated in FIG. 15A, the flat plate portion 71 moves in the direction reverse to the above-mentioned urging direction (relatively approaches opposing wall portion 85) against the urging of the coil spring 90, while as illustrated in FIG. 15B, the flat plate portion 71 itself pivots to change the inclination of the flat plate portion 71 to the urging direction. This alleviates the frictional resistance and stress caused upon contact between the hole portion 42 and the positioning pin 74, and facilitates the fit of the positioning pin 74 into the hole portion 42.

When the fit of the drum shafts $\mathbf{1}a_1$ to $\mathbf{1}d_1$ into the bearing holes 73*a* to 73*d*, respectively, and the fit of the positioning pins 74/74 into the hole portions 42/42 are thus completed, as illustrated in FIG. 13B, the tip of the abutment portion 85*p* is brought into abutment with the flat plate portion 71, thereby completing the positioning. At this time, the tips of the hooks 83/83 are fitted into and engaged with the hole portions 43/43 of the front side plate 41, and the positioning device 60 is completely fixed to the apparatus main body.

As described above, according to the positioning device 60 of this embodiment, as long as the pivot shaft 80*a* of the holder portion 80 is supported on a side of the apparatus main body, the positioning device 60 remains on the side of the apparatus main body without being completely separated from the apparatus main body before and after the pivot. Accordingly, work of mounting/removal of the positioning plate 70 can be performed in a position close to the apparatus main body. Further, the positioning device 60 repeats the pivot with the pivot shaft 80*a* as a fulcrum in the same trail, and hence the pivot of the positioning device 60 can reliably mount the positioning plate 70 in a normal position each time the respective process units 50*a* to 50*d* are attached/detached or replaced, and a mount position of the positioning plate 70 need not be adjusted with a sense of the hand every replacement described above. Therefore, the work of mounting/removal of the positioning plate 70 can be performed smoothly when the respective process units 50*a* to 50*d* are attached/detached or replaced, which can remarkably improve workability exhibited when the respective process units 50*a* to 50*d* are attached/detached and replaced.

Further, the holder portion 80 of the positioning device 60 holds the positioning plate 70 so that the position of the flat plate portion 71 relative to the opposing wall portion 85 changes against the urging of the coil spring 90 by the contact between the bearing holes 73*a* to 73*d* and the drum shafts $\mathbf{1}a_1$ to $\mathbf{1}d_1$, respectively, when the drum shafts $\mathbf{1}a_1$ to $\mathbf{1}d_1$ are fitted into the bearing holes 73*a* to 73*d*, respectively, by the pivot. Accordingly, the above-mentioned frictional resistance and stress caused upon contact can be alleviated by the relative and continuous position change of the flat plate portion 71 with respect to the opposing wall portion 85. Therefore, even with the structure in which the holder portion 80 is caused to pivot, it is possible to smoothly perform the fit of the drum shafts $\mathbf{1}a_1$ to $\mathbf{1}d_1$ into the bearing holes 73*a* to 73*d*, respectively. In addition, the frictional resistance and stress can be alleviated with a simple structure using the coil spring 90, and hence it is possible to easily realize a structure in which the mounting/removal of the positioning plate 70 is performed by the pivot of the holder portion 80.

Further, the holder portion 80 can be caused to pivot to perform the mounting/removal of the positioning plate 70 by a simple operation using the lever 84, which further improves workability exhibited when the respective process units 50*a* to 50*d* are attached/detached or replaced.

Further, the clearance t is formed between the insertion port 72*a* of the insertion portion 72 of the positioning plate 70 and the pivot shaft 83*a*, and hence the flat plate portion 71 is supported so as to be able to be displaced (able to move in parallel and able to pivot) relative to the opposing wall portion 85 by the clearance t. Accordingly, while the frictional resistance and stress between the bearing holes 73*a* to 73*d* and the drum shafts $\mathbf{1}a_1$ to $\mathbf{1}d_1$ is reliably alleviated by the position change of the flat plate portion 71, the drum shafts $\mathbf{1}a_1$ to $\mathbf{1}d_1$ can be reliably and smoothly fitted into the bearing holes 73*a* to 73*d*, respectively.

Figure 16:
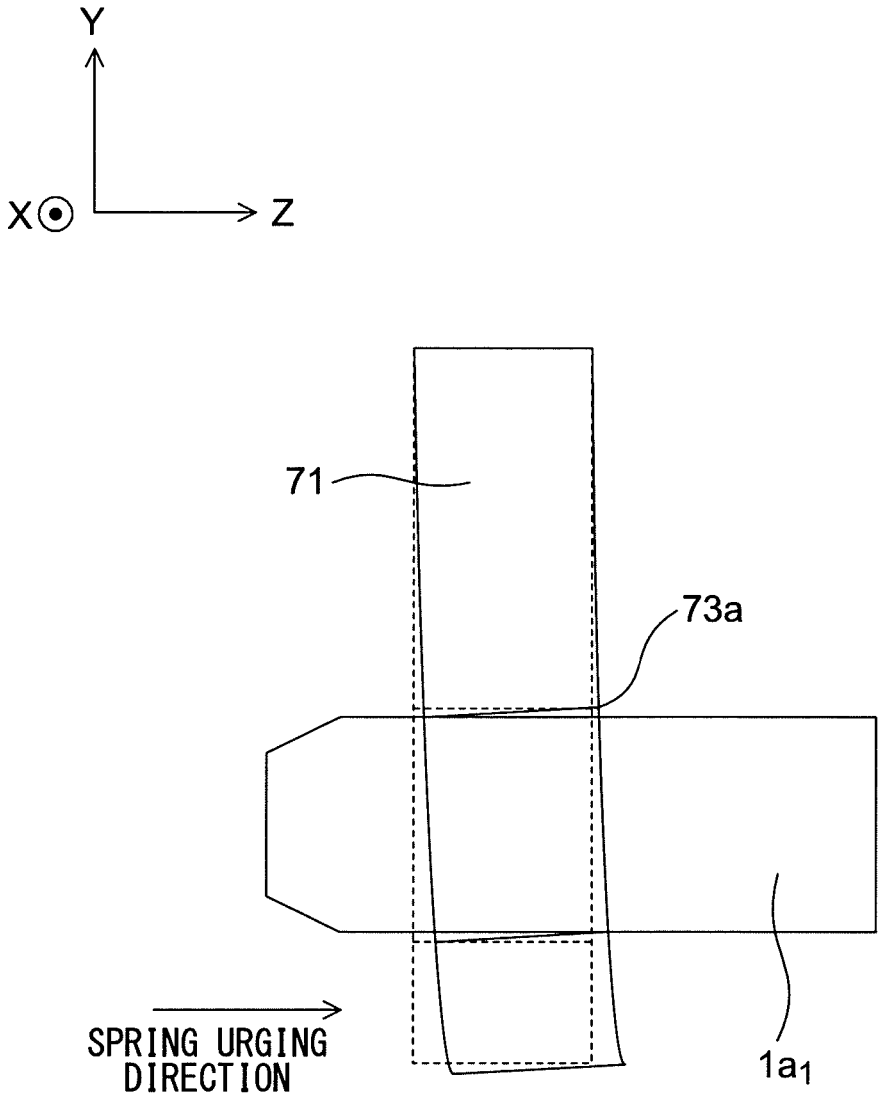
FIG. 16 is an enlarged sectional view illustrating a contact portion between the bearing hole of the above-mentioned flat plate portion and the drum shaft.

Further, the above-mentioned coil spring 90 urges the position displaced from the center of the flat plate portion 71 within the plane perpendicular to the pivot shaft 80*a* of the holder portion 80 (see FIG. 13A and FIG. 13B). Accordingly, a slight warp can be given to the flat plate portion 71 within the above-mentioned sectional plane. Here, FIG. 16 is an enlarged sectional view illustrating a contact portion between the bearing hole 73*a* of the flat plate portion 71 and the drum shaft $\mathbf{1}a_1$. As illustrated in FIG. 16, even when a slight clearance is present between the bearing holes 73*a* and the drum shaft $\mathbf{1}a_1$ in the positioned state, the bearing holes 73*a* and the drum shaft $\mathbf{1}a_1$ can be reliably brought into line contact or plane contact with each other because of the above-mentioned warp of the flat plate portion 71. Note that, the same applies to contact portions between the bearing holes 73*b* to 73*d* and the drum shafts $\mathbf{1}b_1$ to $\mathbf{1}d_1$, respectively. As a result, it is possible to prevent a wobble of the drum shafts $\mathbf{1}a_1$ to $\mathbf{1}d_1$ in the positioned state, and it is also possible to stabilize electrical continuity when the drum shafts $\mathbf{1}a_1$ to $\mathbf{1}d_1$ and the positioning plate 70 are grounded.

Further, the above-mentioned coil spring 90 urges the positioning pin 74 fixed to the flat plate portion 71 from the back end, and hence the urging force of the coil spring 90 can be efficiently given to the positioning pin 74. Accordingly, even with the structure in which the holder portion 80 is caused to pivot, it is possible to smoothly perform the fit of the positioning pin 74 into the hole portion 42 of the front side plate 41 of the apparatus main body while suppressing the frictional resistance of both, and it is possible to smoothly perform the positioning of the positioning plate 70.

Further, in the positioning plate 70, the bearing holes 73*a* to 73*d* and the positioning pins 74/74 are located in the same straight line in the X direction, and hence it is possible to simultaneously perform the fit of the drum shafts $\mathbf{1}a_1$ to $\mathbf{1}d_1$ into the bearing holes 73*a* to 73*d*, respectively, and the fit of the positioning pins 74/74 into the hole portions 42/42, respectively, by the pivot of the holder portion 80. Moreover, the position change of the flat plate portion 71 against the urging of the coil spring 90 upon the fit acts upon the respective fitted portions in the same manner, and hence all the respective fits can be smoothly performed simultaneously.

(4. Waste Toner Conveying Device)

Figure 17:
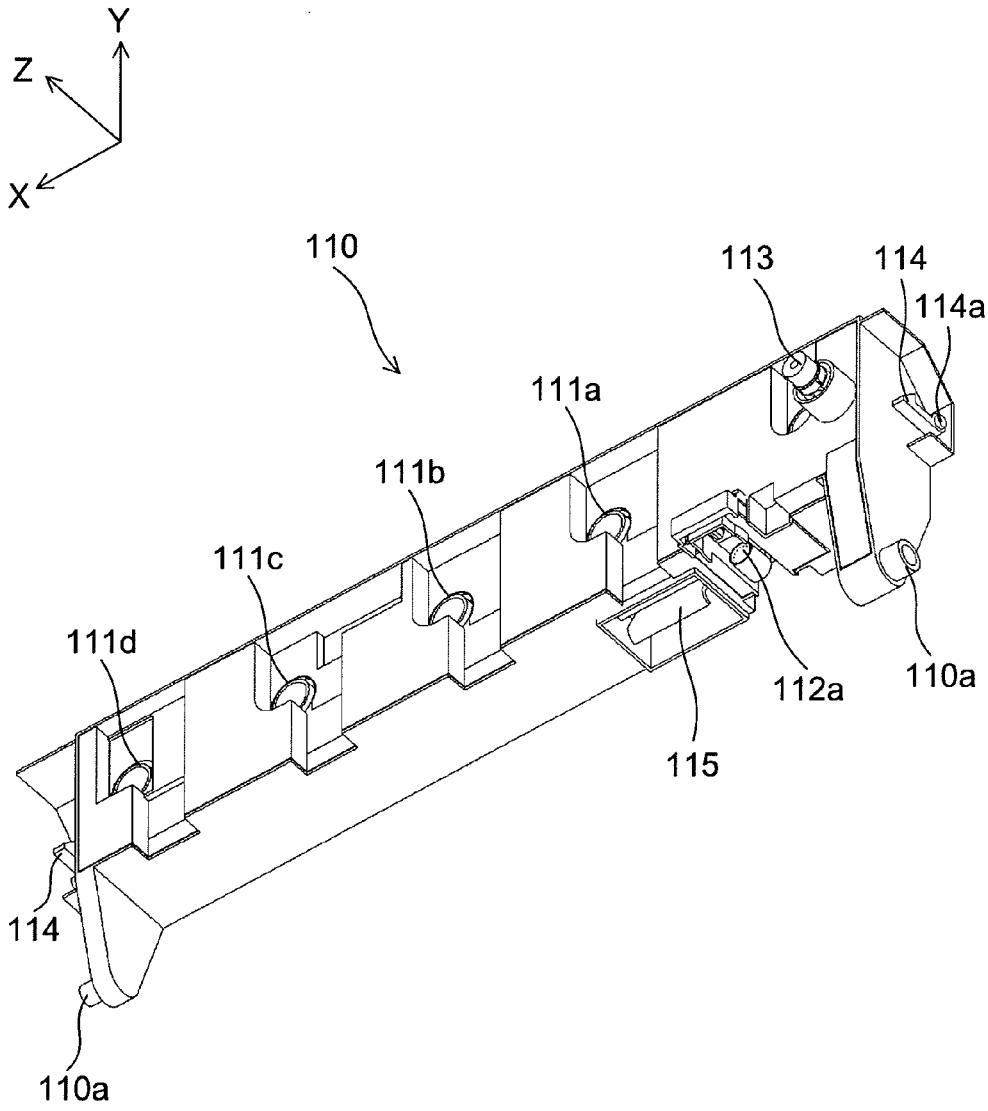
FIG. 17 is a perspective view illustrating a schematic structure of a waste toner conveying device of the above-mentioned image forming apparatus.

Next described is a waste toner conveying device included in the image forming apparatus 200. FIG. 17 is a perspective view illustrating a schematic structure of the waste toner conveying device 110. The waste toner conveying device 110 is a device attached to/detached from the waste toner outlets 51*a* to 51*d* of the respective process units 50*a* to 50*d* (see FIG. 9), for conveying the toner, which is collected by the respective cleaning devices (corresponding to cleaning devices 5*a* to 5*d* of FIG. 1 and FIG. 3) and discharged from the waste toner outlets 51*a* to 51*d*, respectively, to the collection container 120 (see FIG. 18). The waste toner conveying device 110 includes a pivot shaft 110*a*, connection ports 111*a* to 111*d*, a conveyance portion 112 (see FIG. 18), a convex portion 113, hooks 114/114, and a lever 115.

The pivot shaft 110*a* is supported by the apparatus main body so as to be located in parallel with the X direction in which the waste toner outlets 51*a* to 51*d* of the process units 50*a* to 50*d*, respectively, are arrayed. The pivot shaft 110*a* is located below the connection ports 111*a* to 111*d* in the Y direction, and is therefore located below the waste toner outlets 51*a* to 51*d* connected to the connection ports 111*a* to 111*d*, respectively, in the Y direction. By thus locating the pivot shaft 110*a*, the waste toner conveying device 110 can be caused to pivot with the pivot shaft 110*a* as a fulcrum so as to be opened from an upper side of the front surface of the apparatus main body.

Figure 18:
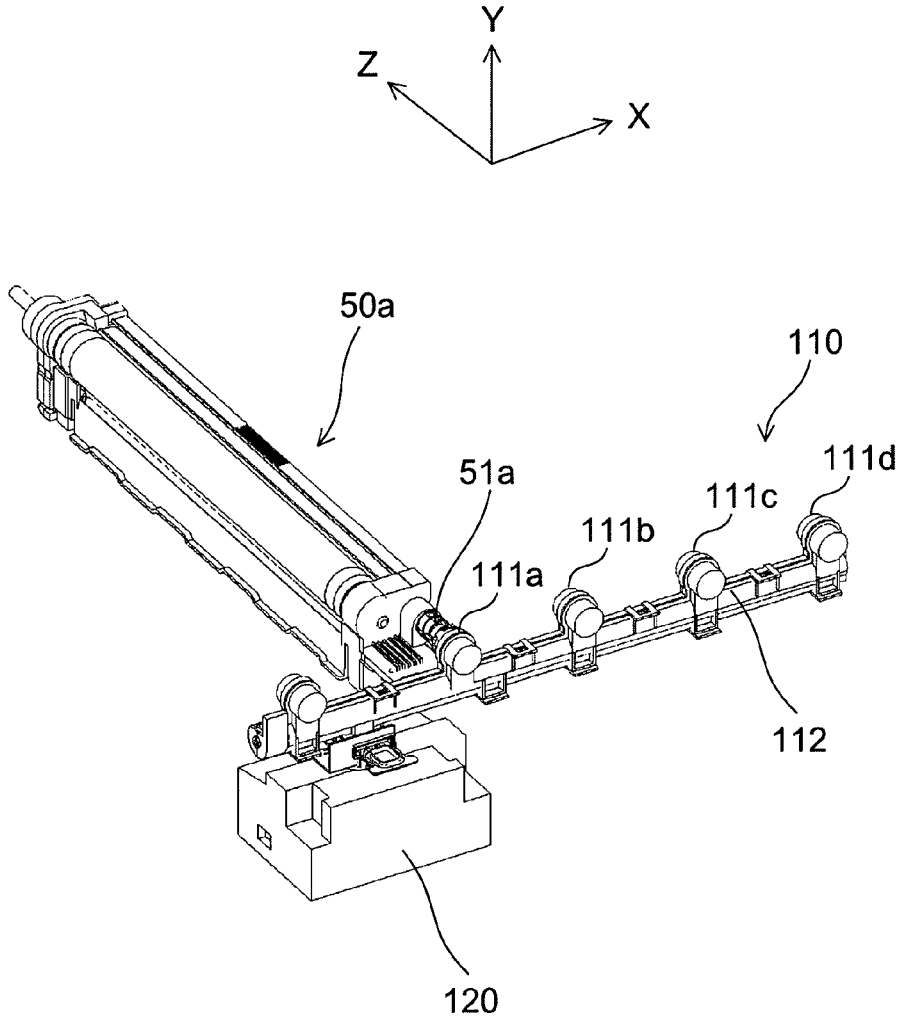
FIG. 18 is a perspective view illustrating a structure of a conveyance portion of the above-mentioned waste toner conveying device.

The connection ports 111*a* to 111*d* are parts for being attached to/detached from the waste toner outlets 51*a* to 51*d* of the process units 50*a* to 50*d*, respectively. Here, FIG. 18 is a perspective view of the conveyance portion 112. Note that, for the sake of convenience, FIG. 18 illustrates only the process unit 50*a* among the process units 50*a* to 50*d*. The toner for disposal that has been conveyed from the waste toner outlets 51*a* to 51*d* to an internal portion via the above-mentioned connection ports 111*a* to 111*d*, respectively, is conveyed along the X direction by the conveyance portion 112, and is discharged to the collection container 120 via a discharge outlet 112*a* (see FIG. 17).

The convex portion 113 is fitted into a hole portion 44 (see FIG. 20) of the front side plate 41 of the apparatus main body, and performs the positioning of the waste toner conveying device 110 with respect to the apparatus main body. As illustrated in FIG. 17, the connection ports 111*a* to 111*d* and the convex portion 113 are located in the same straight line in the X direction.

The hooks 114/114 are engagement members that are engaged with hole portions 45/45 (see FIG. 20) of the front side plate 41 of the apparatus main body and provided at both ends of a pivot shaft 114*a* penetrating side surface portions of the waste toner conveying device 110, and are caused to pivot with the pivot shaft 114*a* as a fulcrum. The hooks 114/114 are urged by a spring (not shown) in such a pivot direction as to be engaged with the apparatus main body. Note that, the pivot shaft 114*a* between the hooks 114/114 is provided in parallel with the pivot shaft 110*a* of the waste toner conveying device 110 and provided above the pivot shaft 110*a* in the Y direction.

The lever 115 is provided so as to be interlocked with the hooks 114/114, and when the lever 115 is pulled, the hooks 114/114 are caused to pivot with the pivot shaft 114*a* as a fulcrum in a direction reverse to such a pivot direction as to be engaged with the apparatus main body. This releases the engagement of the hooks 114/114 with the apparatus main body, which allows the waste toner conveying device 110 to pivot.

The waste toner conveying device 110 having the above-mentioned structure is provided to the positioning device 60 on a side opposite to the respective process units 50*a* to 50*d*. That is, the positioning device 60 is located on an outer side (front surface side) of the respective process units 50*a* to 50*d* in the Z direction, and the waste toner conveying device 110 is located further on an outer side (front surface side) thereof in the Z direction. Therefore, in this structure, without first pivoting and opening the waste toner conveying device 110, the positioning device 60 cannot be next pivoted and opened, while without first pivoting and closing the positioning device 60, the waste toner conveying device 110 cannot be next pivoted and closed.

Figure 19:
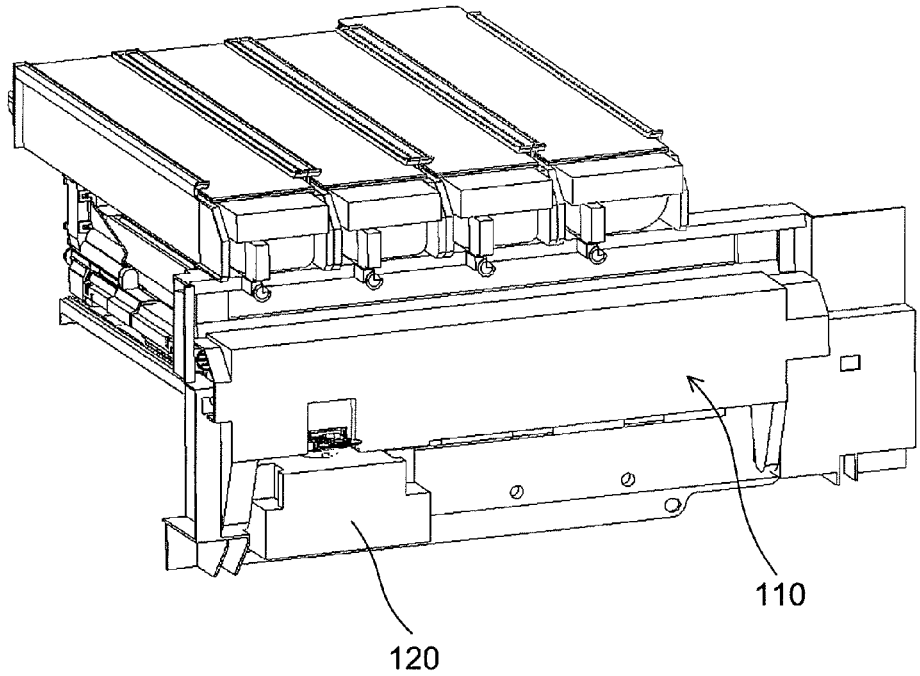
FIG. 19 is a perspective view illustrating a state before the above-mentioned waste toner conveying device is caused to pivot with respect to the apparatus main body.
Figure 20:
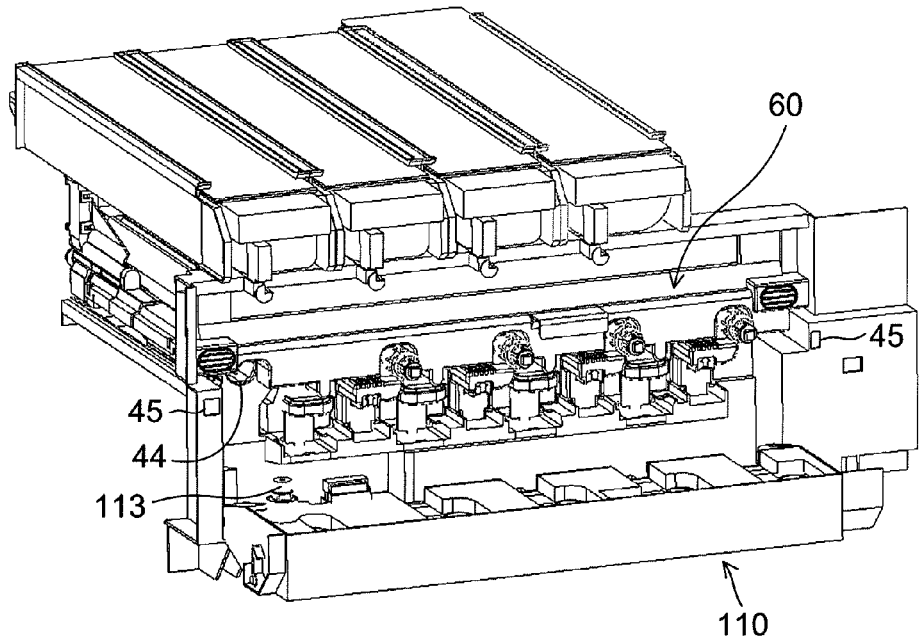
FIG. 20 is a perspective view illustrating a state when the above-mentioned waste toner conveying device is caused to pivot with respect to the apparatus main body.

Next described is a procedure for work of replacement of the respective process units 50*a* to 50*d* including an operation of the waste toner conveying device 110. FIG. 19 is a perspective view illustrating a position of the waste toner conveying device 110 with respect to the apparatus main body in the initial state. To replace the respective process units 50*a* to 50*d*, a front cover (not shown) of the apparatus main body is first opened, and then the lever 115 of the waste toner conveying device 110 is pulled to release the engagement with the apparatus main body realized by the hooks 114/114 to cause the waste toner conveying device 110 to pivot with the pivot shaft 110*a* as a fulcrum. At this time, from the above-mentioned positional relationship between the pivot shaft 110*a* and the waste toner outlets 51*a* to 51*d*, as illustrated in FIG. 20, the waste toner conveying device 110 is caused to pivot so as to be opened from the upper side of the front surface of the apparatus main body.

Figure 21:
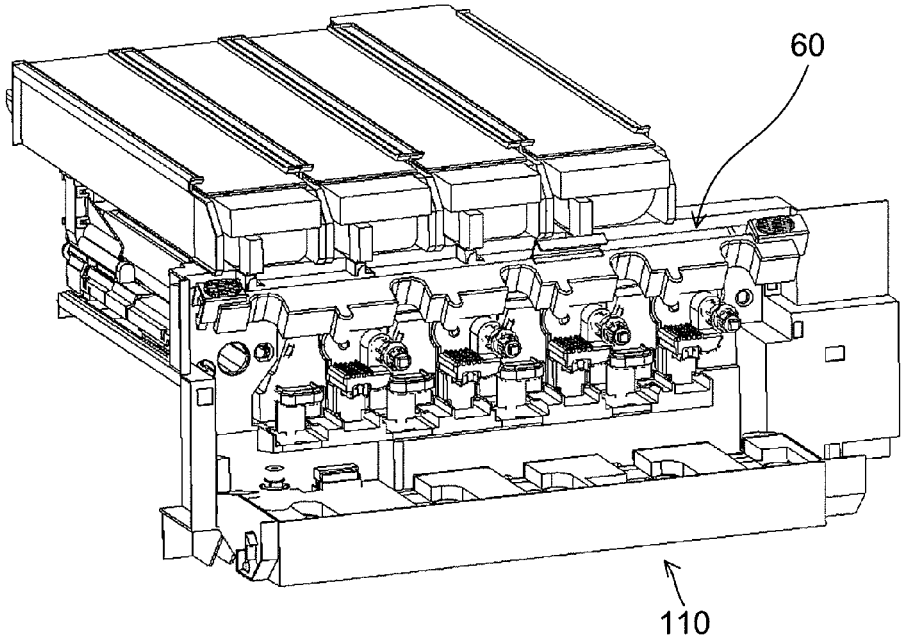
FIG. 21 is a perspective view illustrating a state when the above-mentioned process unit positioning device is caused to pivot with respect to the apparatus main body.
Figure 22:
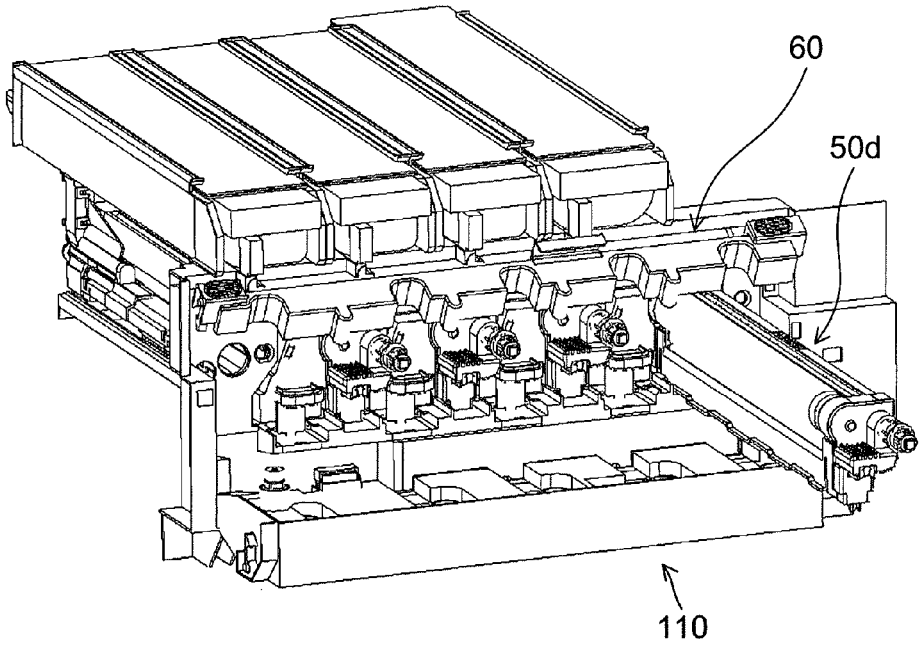
FIG. 22 is a perspective view illustrating a state when the above-mentioned process unit is pulled out of the apparatus main body.

When the waste toner conveying device 110 is caused to pivot, the positioning device 60 existing on an inner side thereof is exposed. This allows the positioning device 60 to pivot, and the above-mentioned technique is used to thereby cause the positioning device 60 to pivot. At this time, from the above-mentioned positional relationship between the pivot shaft 80*a* and the drum shafts $\mathbf{1}a_1$ to $\mathbf{1}d_1$, as illustrated in FIG. 21, the positioning device 60 is caused to pivot so as to be opened from the lower side of the front surface of the apparatus main body. Accordingly, the positioning of the process units 50*a* to 50*d* is released, which allows, as illustrated in FIG. 22, for example, the process unit 50*d* to be extracted and replaced. Note that, the developing units 3*a* to 3*d* can also be replaced in the state of FIG. 22. After the replacement, a normal state can be recovered by the reverse procedure.

As described above, in the image forming apparatus 200, the waste toner conveying device 110 is provided on the side opposite to the respective process units 50*a* to 50*d* across the positioning device 60. By thus locating the waste toner conveying device 110 on the outer side the positioning device 60 in the drum shaft direction, there is no need to operate the positioning device 60 when the collection container 120 is removed from the apparatus main body in order to dispose of the toner for disposal that has been conveyed by the waste toner conveying device 110 and accumulated in the collection container 120. In other words, in the above-mentioned structure, the collection container 120 can be removed from the apparatus main body without opening the positioning device 60, for example, in the state of FIG. 19. Accordingly, work of disposing of waste toner can be efficiently performed, which can improve the workability. In particular, the work of disposing of waste toner is often performed simultaneously with, for example, the replacement of the toner cartridge, and a frequency thereof is much higher than the frequency of the replacement of the process units 50*a* to 50*d*, which extremely enhances the above-mentioned effect.

Further, the positioning device 60 is located in the inner side (each process unit side) of the waste toner conveying device 110, which can alleviate even a small amount of deflection due to the drum shafts $\mathbf{1}a_1$ to $\mathbf{1}d_1$ being elongated in the process units 50*a* to 50*d*, respectively.

Further, the pivot shaft 110*a* of the waste toner conveying device 110 is located in parallel with the X direction in which the respective waste toner outlets 51*a* to 51*d* are arrayed, and hence the attachment/detachment of the waste toner outlets 51*a* to 51*d* to/from the pivoted waste toner conveying device 110 can be simultaneously performed for all the waste toner outlets 51*a* to 51*d*. In addition, the pivot shaft 110*a* is located below the respective waste toner outlets 51*a* to 51*d*, and the waste toner conveying device 110 is opened from the upper side with the pivot shaft 110*a* as a fulcrum. Accordingly, when the waste toner conveying device 110 is brought into an opened state, the waste toner that drops from the respective waste toner outlets 51*a* to 51*d* to an installation surface for the image forming apparatus 200 can be received by the waste toner conveying device 110, which prevents the installation surface from becoming dirty with the waste toner.

Further, the pivot shaft 80*a* of the positioning device 60 is located above the drum shafts $\mathbf{1}a_1$ to $\mathbf{1}d_1$ of the process units 50*a* to 50*d*, respectively, and the positioning device 60 is opened from the lower side with the pivot shaft 80*a* as a fulcrum. As described above, by setting the different directions in which the waste toner conveying device 110 and the positioning device 60 are opened from the apparatus main body, as in this embodiment, such a structure can be realized that the waste toner conveying device 110 is opened on the side of the pivot shaft 80*a* of the positioning device 60 and that the positioning device 60 is opened on the side of the pivot shaft 110*a* of the waste toner conveying device 110. In other words, in the above-mentioned structure, the waste toner conveying device 110 and the positioning device 60 can be caused to pivot so as to expose a part between the pivot shaft 110*a* and the pivot shaft 80*a*. In this case, even when both the waste toner conveying device 110 and the positioning device 60 are brought into an opened state, a wide space for insertion/extraction of the respective process units 50*a* to 50*d* and the respective developing units 3*a* to 3*d* can also be secured without interference therebetween. As a result, the replacement work for the respective process units 50*a* to 50*d* and the respective developing units 3*a* to 3*d* is performed with ease.

(5. Regarding Toner Supply Portion)

Incidentally, the image forming apparatus 200 is provided with toner supply portions for supplying the toner from the toner cartridges to the developing units 3*a* to 3*d*. In this embodiment, as described above, the waste toner conveying device 110 is located on the front surface side of the apparatus main body. If the toner supply portion is located on the front surface side of the apparatus main body in the same manner, the toner supply portion must be structured to have a complicated shape in order to prevent the toner supply portion from interfering with the waste toner conveying device 110, and further, a toner forwarding mechanism (for example, screw) needs to be provided inside of the toner supply portion in order to reliably supply the toner. Thus, the structure of the toner supply portion and the design of the apparatus/device become complicated. Therefore, in this embodiment, the above-mentioned inconvenience is avoided by locating the toner supply portion on a back side of the apparatus main body. Hereinafter, an arrangement position of the toner supply portion is described in detail.

Figure 23:
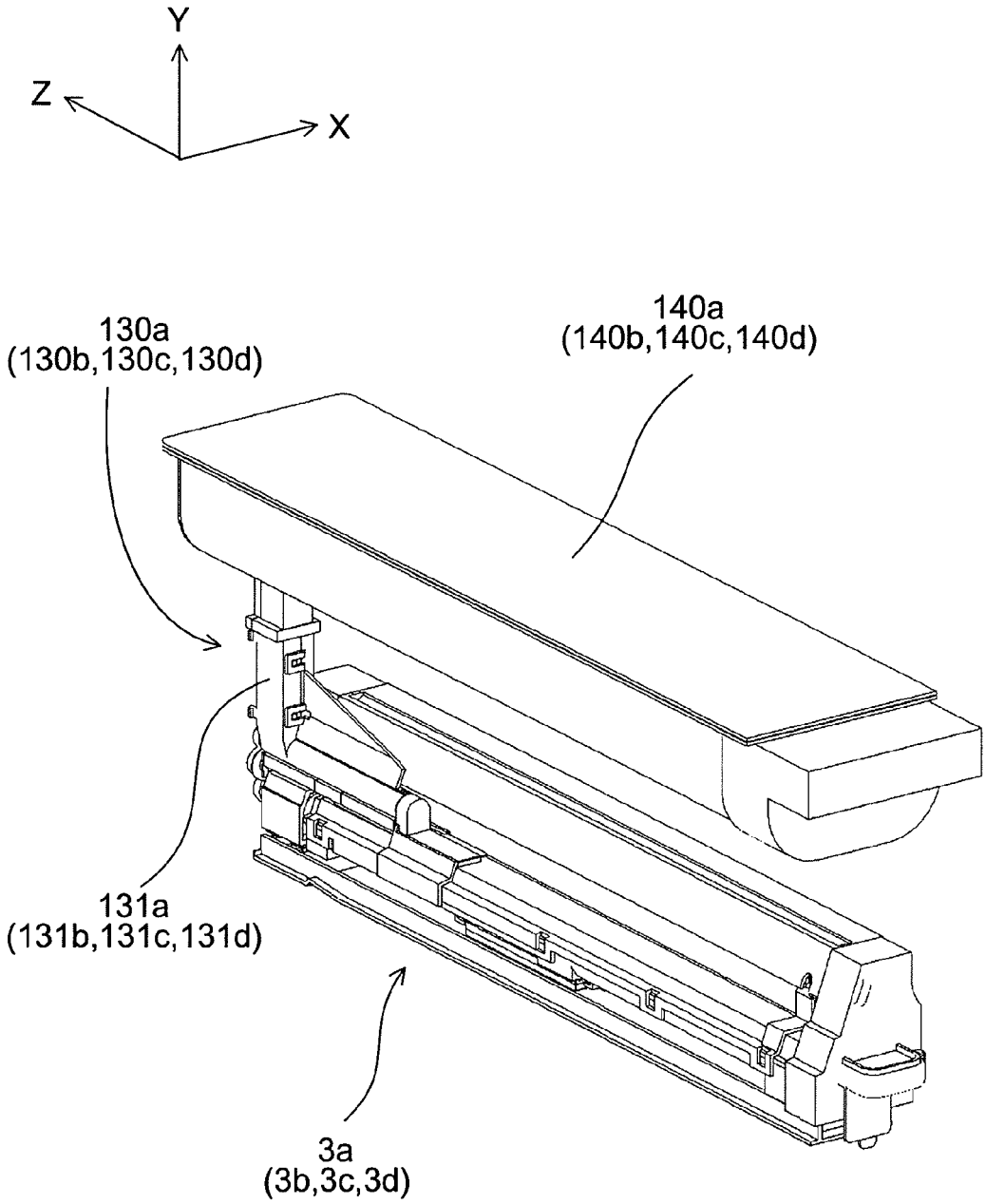
FIG. 23 is a perspective view illustrating a positional relationship among the developing unit, a toner supply portion, and a toner cartridge of the above-mentioned image forming apparatus.

FIG. 23 is a perspective view illustrating a positional relationship among the developing unit 3*a*, the toner supply portion 130*a*, and the toner cartridge (toner container) 140*a*. Note that, the same applies to positional relationships among the developing units 3*b* to 3*d*, the toner supply portions 130*b* to 130*d*, and toner cartridges 140*b* to 140*d*, respectively. The above-mentioned intermediate transfer belt 8 (see FIG. 1 and FIG. 3) is rotated between the toner cartridges 140*a* to 140*d* and the developing units 3*a* to 3*d*, respectively.

The toner supply portions 130*a* to 130*d* are provided corresponding to the developing units 3*a* to 3*d*, respectively, and supplies the toner in predetermined colors from the toner cartridges 140*a* to 140*d* to the developing units 3*a* to 3*d*, respectively. The toner supply portions 130*a* to 130*d* are provided corresponding to end portions of the developing units 3*a* to 3*d*, respectively, on the side opposite to the waste toner conveying device 110. Therefore, the respective toner supply portions 130*a* to 130*d* are located on the side opposite to the waste toner conveying device 110 in the Z direction across the intermediate transfer belt 8. Note that, the toner supply portions 130*a* to 130*d* on the toner discharge side are coupled to the toner supply ports 40*a* to 40*d* (see FIG. 7) of the developing units 3*a* to 3*d*, respectively.

By thus locating the respective toner supply portions 130*a* to 130*d*, the respective toner supply portions 130*a* to 130*d* do not interfere with the waste toner conveying device 110, and the respective toner supply portions 130*a* to 130*d* can be structured to have a simple shape. For example, in this embodiment, the toner supply portions 130*a* to 130*d* include tubular portions 131*a* to 131*d*, respectively. The tubular portions 131*a* to 131*d* are tubular supply portions extending straight in a vertical direction so that the toner supplied from the toner cartridges 140*a* to 140*d*, respectively, drops in their internal portions by the self weight, and design thereof is relatively simple.

As described above, the toner supply portions 130*a* to 130*d* can be formed with a simple shape including the tubular portions 131*a* to 131*d*, and hence even when the toner forwarding mechanism is not provided in the internal portions of the toner supply portions 130*a* to 130*d*, the toner can be supplied from the toner cartridges 140*a* to 140*d* to the developing units 3*a* to 3*d*, respectively.

In particular, the toner supply portions 130*a* to 130*d* include the above-mentioned tubular portions 131*a* to 131*d*, and hence the toner can be supplied to the developing units 3*a* to 3*d* using a free fall of the toner in the internal portions of the tubular portions 131*a* to 131*d*, which can simplify the structures of the toner supply portions 130*a* to 130*d*, respectively.

Second Embodiment

Another embodiment of the present invention is described as follows with reference to the drawings. Note that, for convenience in the following description, the same components as those of the first embodiment are denoted by the same reference symbols, and description thereof is omitted.

In this embodiment, the shapes and structures of the process units 50*a* to 50*d* and the developing units 3*a* to 3*d* are slightly different from those of the first embodiment. Further, the image forming apparatus 200 includes a roller separating/contacting mechanism 151 (see FIG. 26 and the like), and the positioning device 60 is structured corresponding thereto. Hereinafter, this respect is described.

Figure 24:
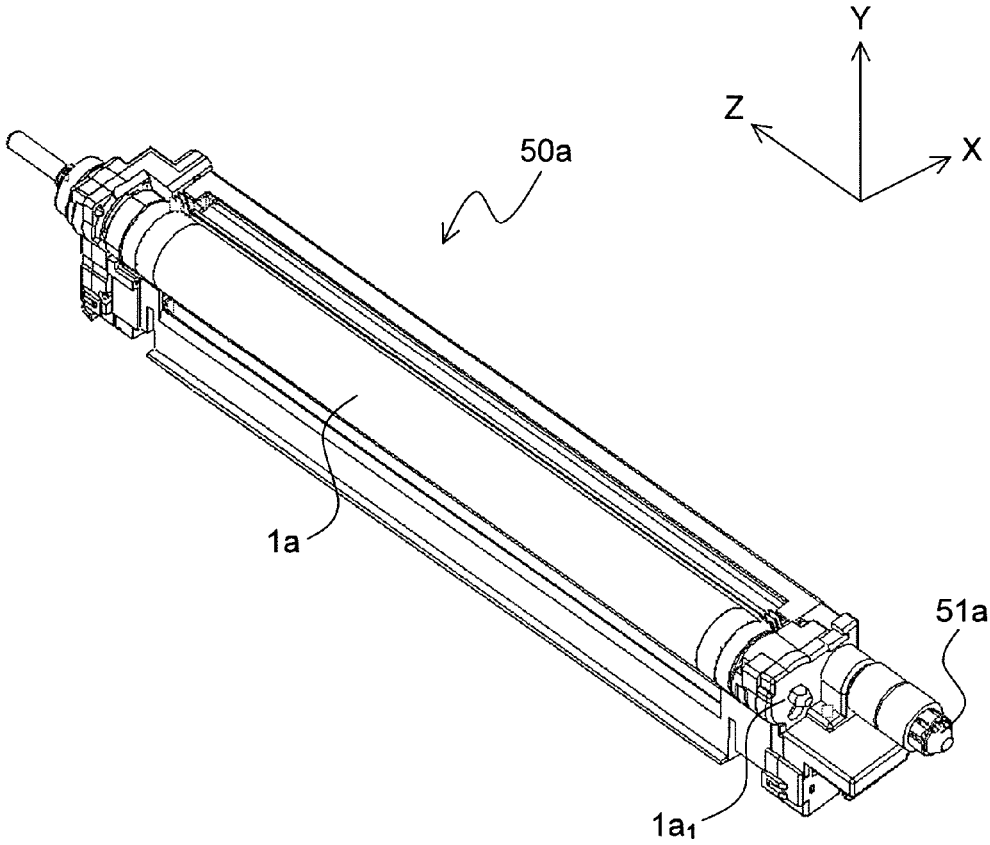
FIG. 24 is a perspective view illustrating an external appearance of a process unit according to another embodiment of the present invention.

FIG. 24 is a perspective view illustrating an external appearance of the process unit 50*a* according to this embodiment. The process unit 50*a* according to this embodiment has substantially the same shape as that of the first embodiment (see FIG. 6), and basic functions thereof are completely the same as those of the first embodiment. Note that, the process units 50*b* to 50*d* of this embodiment have completely the same shape as that of the process unit 50*a* of this embodiment.

Figure 25:
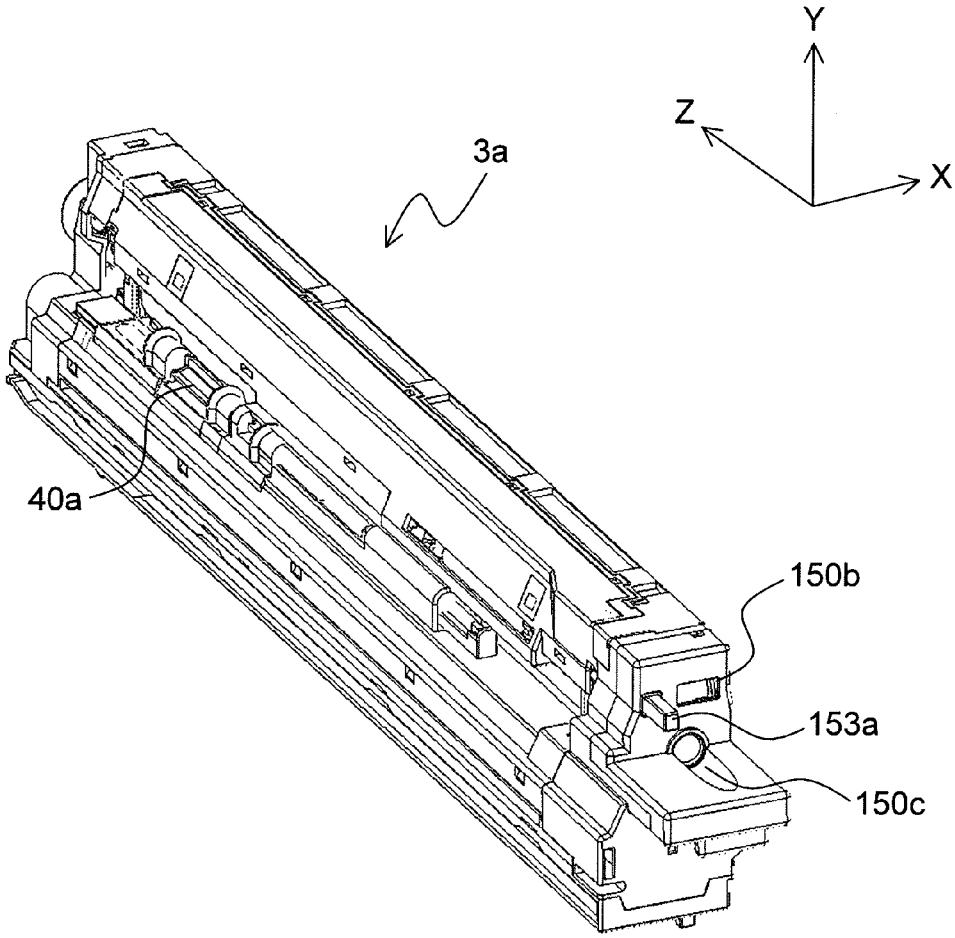
FIG. 25 is a perspective view illustrating an external appearance of a developing unit used along with the above-mentioned process unit.

FIG. 25 is a perspective view illustrating an external appearance of the developing unit 3*a* used along with the process unit 50*a* of this embodiment. An abutment portion 153*a* of a shaft member 153 forming the roller separating/contacting mechanism 151 (see FIG. 26) described later protrudes from front surfaces of the developing units 3*a* to 3*d* opposed to the positioning plate 70 (see FIG. 28) of the positioning device 60 described later. Further, a duct coupling portion 150*b* coupled to a suction duct for sucking airborne toner within the developing units 3*a* to 3*d* is formed in the vicinity of the abutment portion 153*a*. In addition, a fitting hole 150*c* into which each of positioning bosses 86*a* to 86*d* (see FIG. 28) of the positioning device 60 is fitted is formed below the abutment portion 153*a* and the duct coupling portion 150*b*. Note that, the developing units 3*b* to 3*d* of this embodiment basically have the same structure as the developing unit 3*a* of this embodiment.

Figure 26:
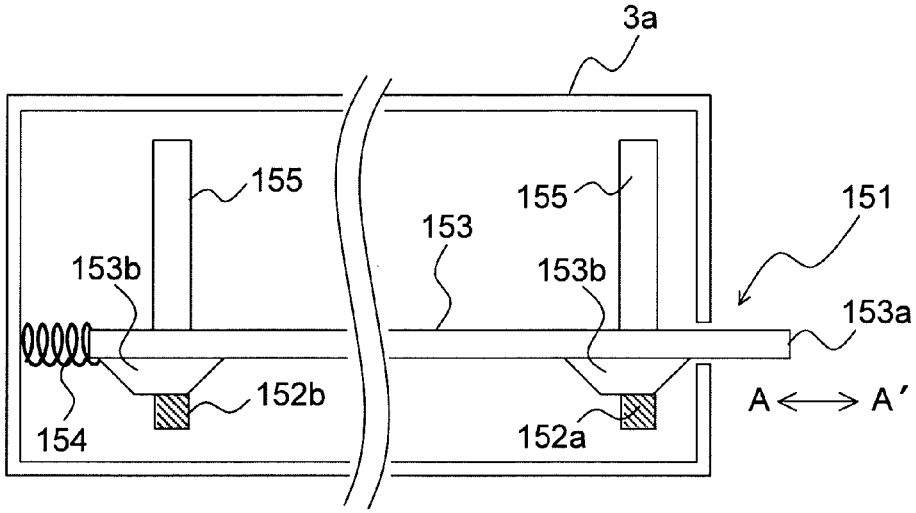
FIG. 26 is a side view illustrating a schematic structure of a roller separating/contacting mechanism provided to the above-mentioned image forming apparatus.

Next described is the roller separating/contacting mechanism 151. The developing units 3*a* to 3*d* include the roller separating/contacting mechanism 151 in which the developing roller 29 is caused to approach or retracted from each of the photosensitive drums 1*a* to 1*d*. FIG. 26 is a schematic side view of the roller separating/contacting mechanism 151, and FIG. 27 is a schematic diagram of a relationship among the roller separating/contacting mechanism 151, the developing roller 29, and the photosensitive drum 1*a* when viewed from the axial direction (right direction of FIG. 26).

Figure 27:
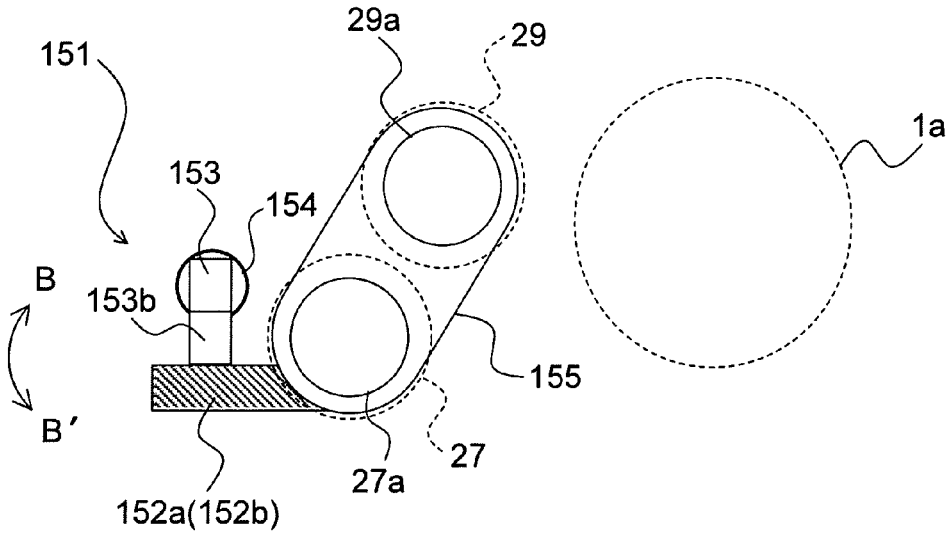
FIG. 27 is an explanatory diagram illustrating a relationship among the above-mentioned roller separating/contacting mechanism, a developing roller, and a photosensitive drum.

FIG. 26 and FIG. 27 are referenced to describe the approach and retraction of the developing roller 29 to/from each of the photosensitive drums 1*a* to 1*d*, which are realized by the roller separating/contacting mechanism 151. Note that, here, the roller separating/contacting mechanism 151 of the developing unit 3*a* is described, but the same applies to the developing units 3*b* to 3*d*, and hence description thereof is omitted. The roller separating/contacting mechanism 151 includes arm members 152*a*/152*b*, the shaft member 153, a compression spring 154, and bearing members 155.

The arm members 152*a*/152*b* are abutted against the shaft member 153 from below and applied with an upward urging force in a free state by urging means (not shown) such as a spring. The shaft member 153 is a rod-like member formed of a material having a predetermined stiffness and arranged along a longitudinal direction of the developing unit 3*a*, and is arranged so as to be movable in the axial direction (arrow A-A' direction). The shaft member 153 includes, in its end portion on a front side in the axial direction, the abutment portion 153*a* that can be abutted against the positioning plate 70 (see FIG. 28). Two ribs 153*b*/153*b* having a trapezoidal shape when viewed from the side surface are formed in positions corresponding to the arm members 152*a*/152*b* on a peripheral surface of the shaft member 153.

The compression spring 154 is a shaft urging member for urging the shaft member 153 toward the front side in the axial direction (arrow A' direction) so that the abutment portion 153*a* of the shaft member 153 protrudes from the front side of the developing unit 3*a* in a free state. The bearing member 155 functions as a link member formed integrally with each of the arm members 152*a*/152*b*, for receiving both an end portion of a rotation axis 27*a* of the magnetic roller 27 and an end portion of a rotation axis 29*a* of the developing roller 29, and coupling both the magnetic roller 27 and the developing roller 29 to each other, and is caused to pivot integrally about the rotation axis 27*a* of the magnetic roller 27 as a center. Therefore, when the bearing member 155 is caused to pivot about the rotation axis 27*a* as a center, the developing roller 29 is caused to pivot about the magnetic roller 27 as a center together with the bearing member 155 and approaches or is retracted from the photosensitive drum 1*a*. Note that, the bearing member 155 may be a member separate from the arm members 152*a*/152*b*.

As illustrated in FIG. 26 and FIG. 27, in a state in which the abutment portion 153*a* of the shaft member 153 protrudes from the developing unit 3*a*, the arm members 152*a*/152*b* are brought onto the ribs 153*b*/153*b*, respectively, and pushed down, and the developing roller 29 is in a position retracted from the photosensitive drum 1*a*. When the abutment portion 153*a* is pushed into the developing unit 3*a* from this state, the shaft member 153 moves toward the depth side in the axial direction (arrow A direction), thereby causing the respective arm members 152*a*/152*b* to fall from the ribs 153*b*/153*b*, respectively, and causing the respective arm members 152*a*/152*b* to pivot in the arrow B direction. Then, the bearing member 155 is also caused to pivot in the arrow B direction about the rotation axis 27*a* as a center along with the respective arm members 152*a*/152*b*, and hence the developing roller 29 approaches the photosensitive drum 1*a*.

In addition, when depression of the abutment portion 153*a* is released again, the shaft member 153 moves toward the front side in the axial direction (arrow A' direction) by the urging force applied by the compression spring 154, thereby bringing the arm members 152*a*/152*b* onto the ribs 153*b*/153*b*, respectively, and causing the respective arm members 152*a*/152*b* to pivot in the arrow B' direction. Then, the bearing members 155 are also caused to pivot in the arrow B' direction about the rotation axis 27*a* as a center along with the respective arm members 152*a*/152*b*, and hence the developing roller 29 is retracted from the photosensitive drum 1*a*.

Note that, here, the shaft member 153 is structured to push down the arm member 152*a* on the front side and the arm member 152*b* on the depth side simultaneously by the ribs 153*b*/153*b*, but pivot timings of the respective arm members 152*a*/152*b* may be set to be different from each other. For example, the shaft member 153 may be structured to push down the arm member 152*b* on the depth side first and then the arm member 152*a* on the front side.

Figure 28:
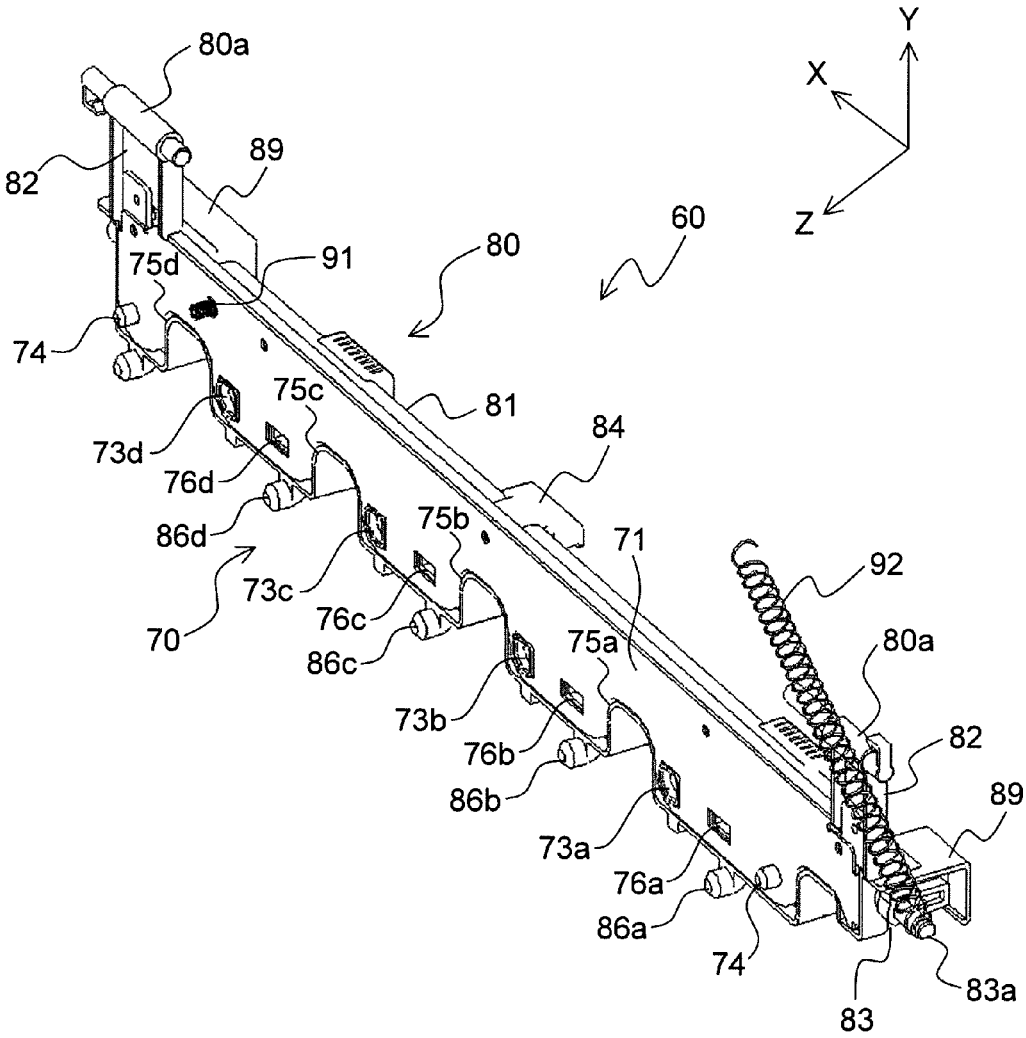
FIG. 28 is a perspective view of the process unit positioning device of the above-mentioned image forming apparatus when viewed from a process unit side.
Figure 29:
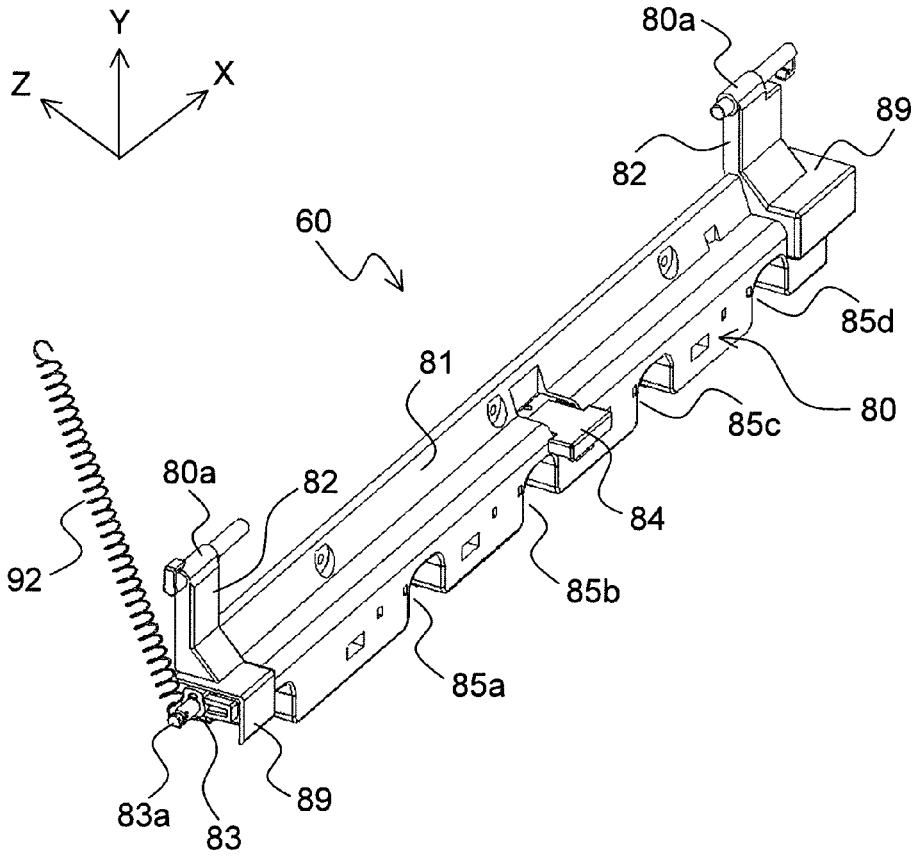
FIG. 29 is a perspective view of the above-mentioned process unit positioning device when viewed from outside the image forming apparatus.

Next described is the positioning device 60 according to this embodiment. FIG. 28 and FIG. 29 are perspective views of the positioning device 60 when viewed from the process unit side and from outside the image forming apparatus, respectively. A basic structure of the positioning device 60 of this embodiment is the same as the positioning device 60 of the first embodiment illustrated in FIG. 8 and the like except for the following points.

In the flat plate portion 71 of the positioning plate 70 of the positioning device 60, openings 76*a* to 76*d* are formed in the vicinities of the bearing holes 73*a* to 73*d*, respectively. By the duct coupling portion 150*b* (see FIG. 25) formed in the front surface of each of the developing units 3*a* to 3*d* being overlapped with each of the openings 76*a* to 76*d*, the duct coupling portion 150*b* and the suction duct (not shown) formed within the holder portion 80 communicate to each other.

Further, when the positioning device 60 is brought into a closed state, a ground spring 91 abutted against the front side plate 41 of the apparatus main body is fixed to the flat plate portion 71 of the positioning plate 70. The photosensitive drums 1*a* to 1*d* are grounded via the ground spring 91 and the positioning plate 70.

Further, the positioning bosses 86*a* to 86*d* are provided so as to protrude from the lower end portion of the main unit 81 of the holder portion 80 of the positioning device 60. When the positioning device 60 is brought into a closed state, the positioning bosses 86*a* to 86*d* are fitted into the fitting holes 150*c* (see FIG. 25) of the developing units 3*a* to 3*d*, respectively.

Further, one end of a tension spring 92 is coupled to one end of the pivot shaft 83*a* between the hooks 83/83 of the main unit 81, and the other end of the tension spring 92 is fixed to the inside of the apparatus main body. The tension spring 92 is a holder urging member for urging the holder portion 80 toward a predetermined pivot direction. The positional relationship between a fixed position of the tension spring 92 and a pivot fulcrum (pivot shaft 80*a* of holder portion 80) of the positioning device 60 is decided so that the urging force of the tension spring 92 acts upon a direction for aiding the pivot operation of the positioning device 60. Specifically, within the apparatus main body, the tension spring 92 is fixed in such a position that the positioning device 60 is urged toward the opened direction when a pivot angle of the positioning device 60 is equal to or larger than a predetermined angle, and that the positioning device 60 is urged toward the closed direction when the pivot angle of the positioning device 60 is smaller than the predetermined angle. Note that, the fixed position of the tension spring 92 is described in detail later.

Next described is a procedure for the replacement work for the respective developing units 3*a* to 3*d* and the respective process units 50*a* to 50*d* including the operations of the positioning device 60 and the waste toner conveying device 110.

In the state of FIG. 19, that is, in a state in which the respective developing units 3*a* to 3*d* and the respective process units 50*a* to 50*d* are loaded into the apparatus main body, as illustrated in FIG. 9, the drum shafts $\mathbf{1}a_1$ to $\mathbf{1}d_1$ of the respective process units 50*a* to 50*d* are fitted into the bearing holes 73*a* to 73*d*, respectively, of the flat plate portion 71 of the positioning device 60, and the mutual positioning of the process units 50*a* to 50*d* is appropriately performed. Further, the positioning pins 74/74 of the positioning device 60 are fitted into the hole portions 42/42 (see FIG. 5A), respectively, of the front side plate 41 of the apparatus main body, and the convex portion 113 of the waste toner conveying device 110 is also fitted into the hole portion 44 (see FIG. 20) of the front side plate 41. Therefore, the positioning of the positioning device 60 and the waste toner conveying device 110 with respect to the apparatus main body is appropriately performed.

When the respective developing units 3*a* to 3*d* and the respective process units 50*a* to 50*d* are replaced from this state, the front cover (not shown) of the apparatus main body is first opened, and the lever 115 (see FIG. 17) of the waste toner conveying device 110 is then pulled to release the engagement between the hooks 114/114 and the hole portions 45/45 (see FIG. 20) formed in the front side plate 41, thereby causing the waste toner conveying device 110 to pivot with the pivot shaft 110*a* as a fulcrum. When the waste toner conveying device 110 is caused to pivot, the positioning device 60 existing on the inner side thereof is exposed as illustrated in FIG. 20.

Figure 30:
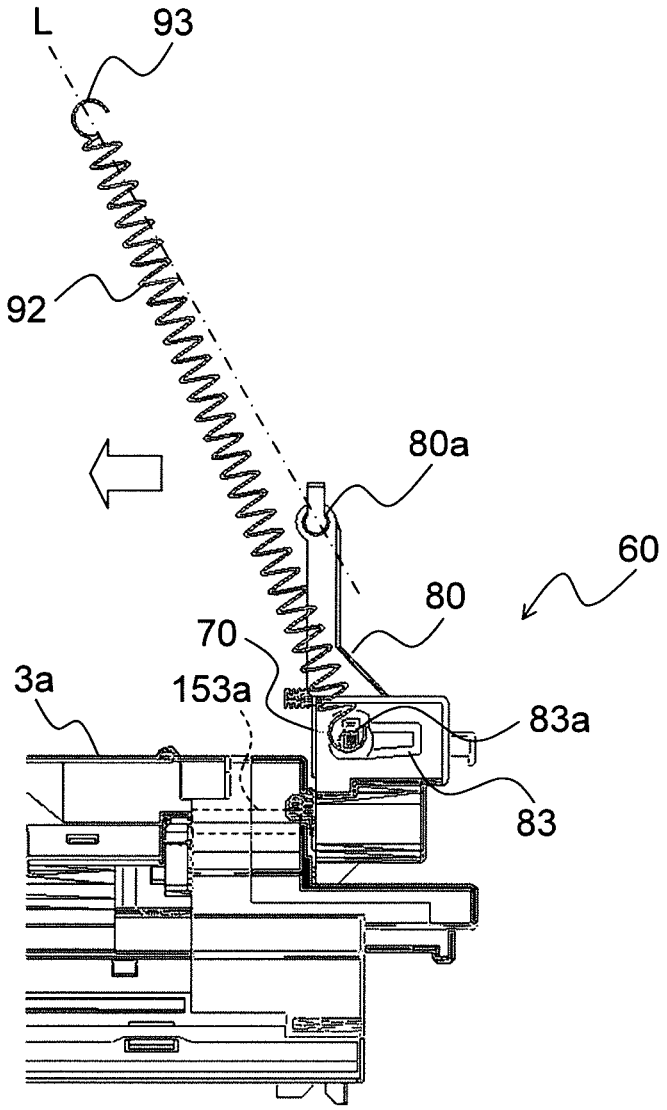
FIG. 30 is a side view illustrating positions of the developing unit and the process unit positioning device of the above-mentioned image forming apparatus in the positioned state.
Figure 32:
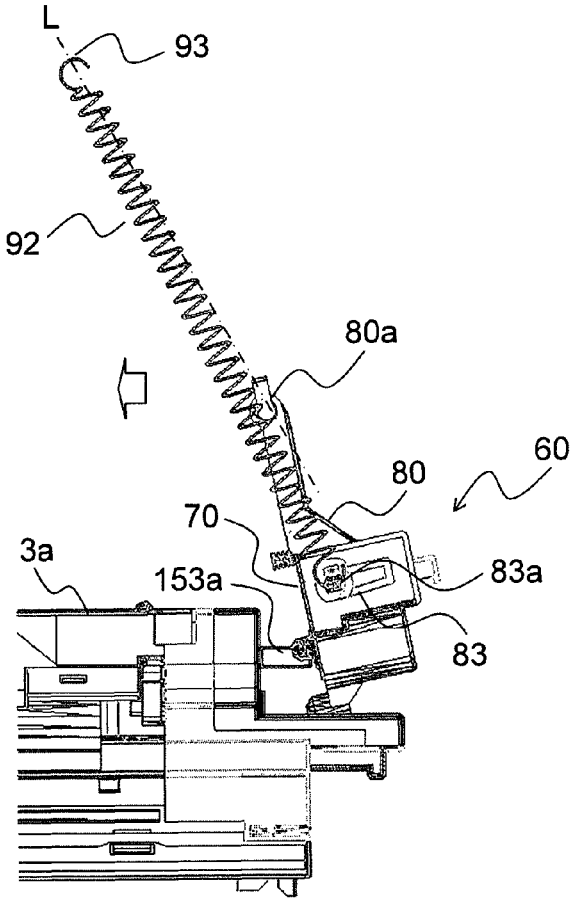
FIG. 32 is a side view of the above-mentioned developing unit and the above-mentioned process unit positioning device in the above-mentioned state.
Figure 34:
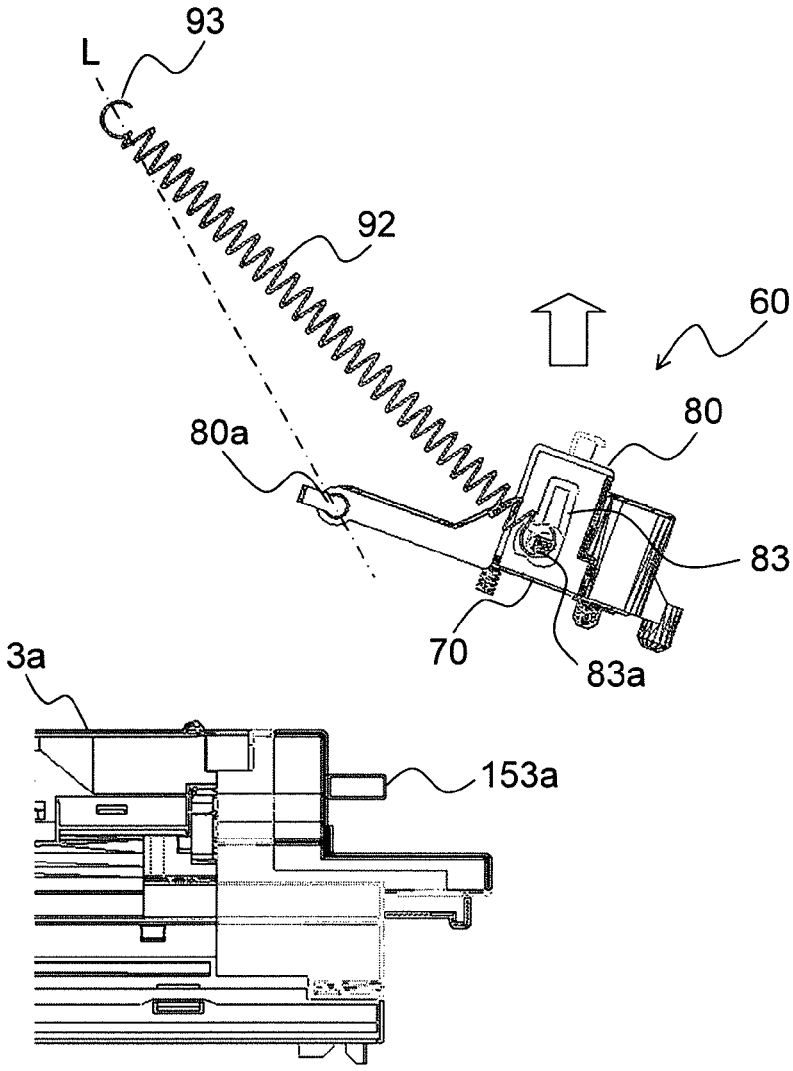
FIG. 34 is a side view of the above-mentioned developing unit and the above-mentioned process unit positioning device in the above-mentioned state.

FIG. 30 is a side view illustrating positions of the developing unit 3*a* and the positioning device 60 in the positioned state when viewed from the left direction of FIG. 20. Note that, FIG. 30 and below-mentioned FIGS. 32 and 34 are referenced to describe a relationship between the developing unit 3*a* and the positioning device 60, while relationships between the developing units 3*b* to 3*d* and the positioning device 60 are also described completely in the same manner.

As illustrated in FIG. 30, the positioning device 60 is located in a position (first position) in which the positioning plate 70 is opposed to the front surfaces of the developing units 3*a* to 3*d*, and the abutment portions 153*a* of the shaft members 153 for separating/bringing the developing rollers 29 of the developing units 3*a* to 3*d* from/into contact with the photosensitive drums 1*a* to 1*d* are pushed into the developing units 3*a* to 3*d*, respectively, by the flat plate portion 71 of the positioning plate 70. Accordingly, the developing rollers 29 of the developing units 3*a* to 3*d* are arranged in proximity to the photosensitive drums 1*a* to 1*d* within the corresponding process units 50*a* to 50*d*, respectively.

Further, the position of a fulcrum 93 is set so that, when the positioning device 60 is in the first position, a straight line L that passes the fulcrum 93 of the tension spring 92 on the side of the apparatus main body and the pivot shaft 80*a* of the holder portion 80 is located above the tension spring 92. Hence, the urging force toward such a direction (white arrow direction in FIG. 30) as to be brought into press contact with the developing units 3*a* to 3*d* acts upon the positioning device 60.

The urging force acting from the tension spring 92 works in such a direction as to alleviate the urging force acting toward the opened direction from the compression spring 154 (see FIG. 26) via the abutment portion 153*a*, and hence loads imposed on the hooks 83/83 are alleviated. Therefore, it is possible to suppress a change and a damage without enhancing the strength of the hook 83.

Figure 31:
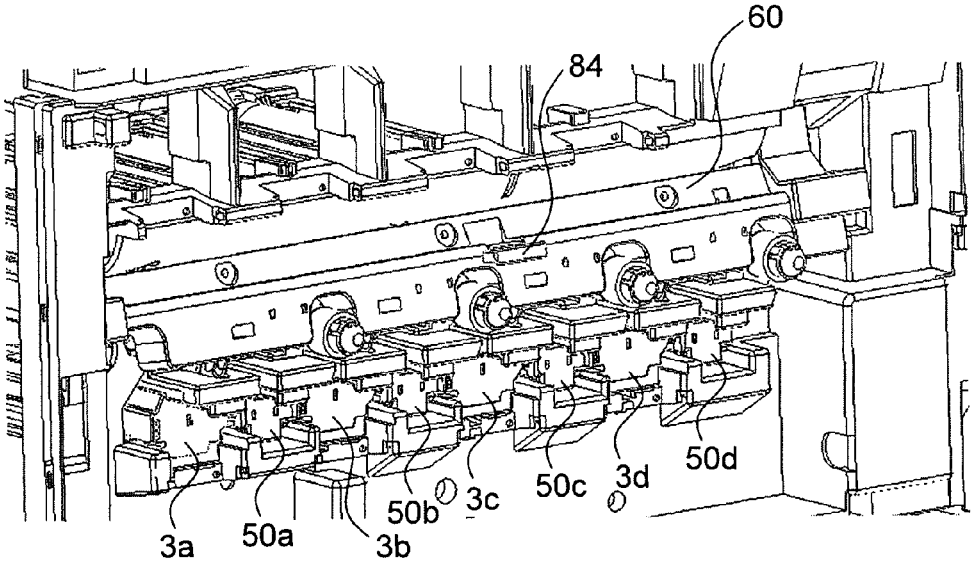
FIG. 31 is a perspective view of developing units and the process unit positioning device in a state in which engagement with the apparatus main body by the hook of the above-mentioned process unit positioning device is released.

Next, the lever 84 provided to the holder portion 80 of the positioning device 60 is operated to cause the hooks 83/83 to pivot with the pivot shaft 83*a* as a fulcrum and release the engagement between the hooks 83/83 and the apparatus main body (the front side plate 41). FIG. 31 is a perspective view of the developing units 3*a* to 3*d* and the positioning device 60 in a state in which the engagement with the apparatus main body by the hooks 83/83 of the positioning device 60 is released, when viewed from the front surface side of the developing units 3*a* to 3*d* and the positioning device 60, and FIG. 32 is a side view of the developing unit 3*a* and the positioning device 60 when viewed from the left direction of FIG. 31.

The urging force of the compression springs 154 acting upon the shaft members 153, which is obtained by adding up the urging forces generated in the respective developing units 3*a* to 3*d*, is stronger than the urging force of the tension spring 92 acting upon the positioning device 60. Hence, when the engagement between the hooks 83/83 and the apparatus main body is released, the abutment portions 153*a* of the shaft members 153 are caused to protrude from the front surfaces of the developing units 3*a* to 3*d* by the urging force of the compression springs 154, and as illustrated in FIG. 32, the positioning device 60 is held in such a position (second position) as to be caused to pivot upward (counterclockwise in FIG. 32) from the position of FIG. 30 by a predetermined angle. At this time, the fit of the drum shafts $\mathbf{1}a_1$ to $\mathbf{1}d_1$ into the bearing holes 73*a* to 73*d*, respectively, and the fit of the positioning pins 74/74 into the front side plate 41 are also released.

Also in the second position, the straight line L that passes the fulcrum 93 of the tension spring 92 on the side of the apparatus main body and the pivot shaft 80*a* of the holder portion 80 is located above the tension spring 92, and hence the urging force toward such a direction (white arrow direction in FIG. 32) as to be brought into press contact with the developing units 3*a* to 3*d* acts upon the positioning device 60. This eliminates such a worry that the user bumps his/her hand against the positioning device 60 bursting open.

Note that, in the second position, an angle formed between the straight line L and the tension spring 92 is smaller than in the first position, and hence the urging force in the white arrow direction that acts upon the positioning device 60 from the tension spring 92 is smaller than in the first position. Hence, when the positioning device 60 is caused to pivot up to a third position described later, which eliminates a fear that the load imposed on the hand may become too heavy.

Figure 33:
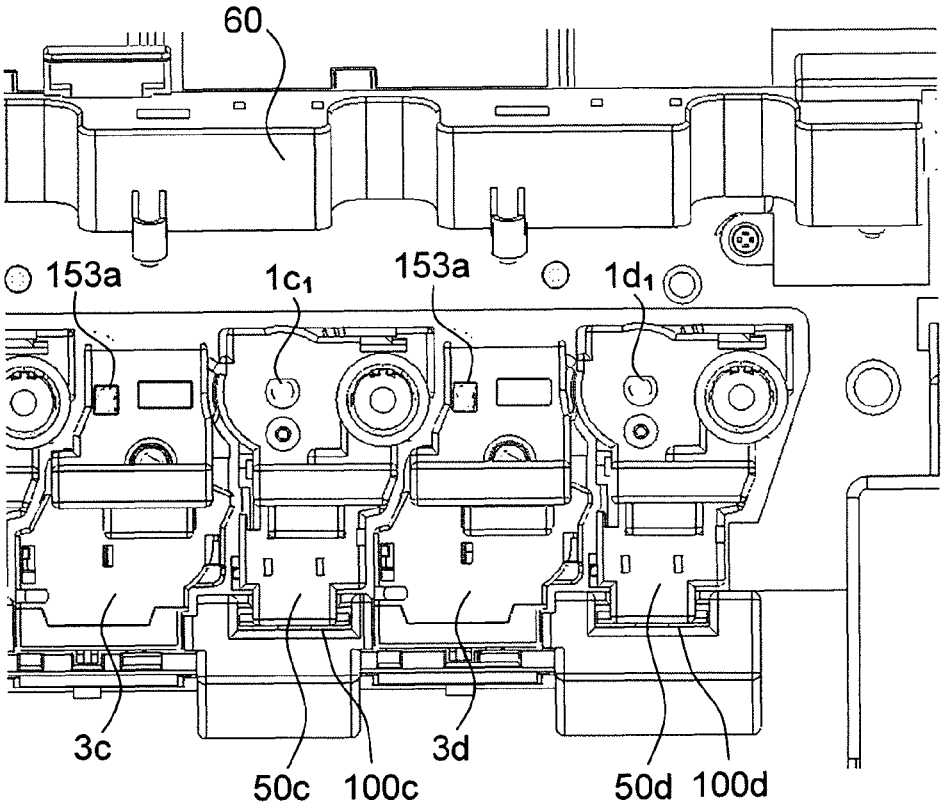
FIG. 33 is an enlarged front view illustrating part of the process units and part of the developing units in a state in which the above-mentioned process unit positioning device is completely opened.

Next, the positioning device 60 is opened up to such a position (third position) as to be caused to further pivot upward from the second position by a predetermined angle with the pivot shaft 80*a* of the holder portion 80 as a fulcrum. When opened up to the third position, the positioning device 60 reaches the position exactly illustrated in FIG. 21. FIG. 33 is an enlarged front view illustrating the vicinities of the process units 50*c* and 50*d* and the developing units 3*c* and 3*d* when the positioning device 60 is caused to pivot up to the third position, and FIG. 34 is a side view of the developing unit 3*a* and the positioning device 60 when viewed from the left direction of FIG. 21.

By opening the positioning device 60 up to the third position, as illustrated in FIG. 21, the developing units 3*a* to 3*d* and the process units 50*a* to 50*d* secure a wide open space in front thereof. In the apparatus main body of the image forming apparatus 200, as illustrated in FIG. 33, guide rails 100*a* to 100*d* for supporting bottom portions of the process units 50*a* to 50*d* so as to be slidable in the front-to-back direction while regulating the position in the horizontal direction are provided so as to extend toward a front side or a depth side (only guide rails 100*c* and 100*d* are illustrated in FIG. 33). When the bearing holes 73*a*, 73*b*, 73*c*, and 73*d* of the positioning device 60 come off the drum shafts $\mathbf{1}a_1$ to $\mathbf{1}d_1$, respectively, the front sides of the process units 50*a* to 50*d* slightly fall downward by the self weight, and the bottom portions are supported by the guide rails 100*a* to 100*d*. The front sides of the photosensitive drums 1*a* to 1*d* also slightly come off the intermediate transfer belt 8. Further, the developing rollers 29 of the developing units 3*a* to 3*d* have been retracted from the photosensitive drums 1*a* to 1*d*, respectively, which allows, as illustrated in FIG. 22, for example, the process unit 50*d* to be extracted and replaced. Further, the other process units 50*a* to 50*c* and the developing units 3*a* to 3*d* can be replaced in the same manner in the state of FIG. 22.

In the third position, as illustrated in FIG. 34, the straight line L that passes the fulcrum 93 of the tension spring 92 on the side of the apparatus main body and the pivot shaft 80*a* of the holder portion 80 is located below the tension spring 92, and hence the urging force toward such a direction (white arrow direction in FIG. 34) as to be spaced apart from the developing units 3*a* to 3*d* acts upon the positioning device 60. Accordingly, the positioning device 60 is held in the third position against the gravity by the urging force of the tension spring 92, which eliminates the need to support the positioning device 60 by the hand and improves replacement workability for the process units 50*a* to 50*d* and the developing units 3*a* to 3*d*.

After the replacement of the developing units 3*a* to 3*d* or the process units 50*a* to 50*d*, the positioning device 60 is caused to pivot downward to be closed by the reverse procedure from the state of FIG. 34, the positioning device 60 is located in the second position illustrated in FIG. 32. At this time, as described above, the urging force toward the closed direction (white arrow direction in FIG. 32) acts upon the positioning device 60, and the positioning device 60 is held in a state of being in contact with a tip of the abutment portion 153*a*, which allows the user to take his/her hand off the positioning device 60 and easily shift his/her grip to another position into which it is easy to put his/her strength.

Then, by forcing the positioning device 60 into the first position illustrated in FIG. 30 from the state of FIG. 32, the abutment portions 153*a* are pushed into the developing units 3*a* to 3*d*, and the developing rollers 29 of the developing units 3*a* to 3*d* are again brought into press contact with the photosensitive drums 1*a* to 1*d*, respectively. Here, the urging force of the tension spring 92 acts toward the closed direction, which can alleviate the load imposed on the hand when the positioning device 60 is attached. Finally, the state of FIG. 19 can be recovered to cause the waste toner conveying device 110 to pivot upward to be closed.

As described above, according to the structure of this embodiment, the waste toner conveying device 110 and the positioning device 60 are merely opened to thereby be able to release the depression between the photosensitive drums 1*a* to 1*d* and the developing rollers 29 of the developing units 3*a* to 3*d*, respectively. Therefore, extraction or insertion of arbitrary units among the respective developing units 3*a* to 3*d* or the respective process units 50*a* to 50*d* is made possible without reference to the order, which can remarkably improve the workability upon the replacement of the respective developing units 3*a* to 3*d* and the respective process units 50*a* to 50*d*.

Further, by adjusting the position of the fulcrum 93 of the tension spring 92, the urging force acting upon the positioning device 60 in the second position in which the positioning device 60 is in contact with the abutment portion 153*a* of the shaft member 153 is set to have the closed direction, which eliminates such a worry that the user bumps his/her hand against the positioning device 60 bursting open when the hooks 83/83 are released and can also alleviate the load imposed when the positioning device 60 is moved from the second position to the first position before being attached. Accordingly, attachment work for the positioning device 60 (positioning plate 70) can be performed smoothly, which can remarkably improve the workability upon the replacement of the respective process units 50*a* to 50*d* and the respective developing units 3*a* to 3*d* even in this respect.

Further, in the first position, the urging force of the tension spring 92 acts upon the closed direction, and hence the load in the opened direction imposed on the hook 83 from the abutment portion 153*a* is alleviated, which also improves durability of the hook 83. In addition, in the third position, the urging force of the tension spring 92 acts upon the opened direction, and hence the replacement of the respective developing units 3*a* to 3*d* and the respective process units 50*a* to 50*d* can be performed with ease by both hands.

Note that, not only the position of a change point at which the direction of the urging force changes but also the magnitudes of the urging force of the tension spring 92 in the first to third positions can also be adjusted by the position of the fulcrum 93 of the tension spring 92. The magnitude of the urging force of the tension spring 92 can also be adjusted by selection of an elastic modulus of the tension spring 92.

Further, as illustrated in FIG. 33, the abutment portions 153*a* of the shaft members 153 are provided on a straight line that passes the drum shafts $\mathbf{1}a_1$ to $\mathbf{1}d_1$ (on the same height as drum shafts $\mathbf{1}a_1$ to $\mathbf{1}d_1$), and when the hooks 83/83 are released, the positioning plate 70 is depressed by the abutment portion 153*a* in positions on the same height as the drum shafts $\mathbf{1}a_1$ to $\mathbf{1}d_1$ (positioning pins 74).

As illustrated in FIG. 13B, the positioning plate 70 is urged by the coil spring 90 toward such a direction as to be spaced apart from the holder portion 80, and the positioning pins 74 are provided on the same straight line in the X direction as the bearing holes 73*a* to 73*d* (drum shafts $\mathbf{1}a_1$ to $\mathbf{1}d_1$). Hence, the direction of a depression force acting upon the positioning plate 70 from the abutment portion 153*a* is exactly reverse to the direction of the urging force acting upon the positioning plate 70 from the coil spring 90. Therefore, the depressed positioning plate 70 becomes hard to incline toward the drum shafts $\mathbf{1}a_1$ to $\mathbf{1}d_1$, and it is possible to suppress the frictional resistance and stress caused upon the contact between the drum shafts $\mathbf{1}a_1$ to $\mathbf{1}d_1$ and the bearing holes 73*a* to 73*d*, respectively, which allows the positioning device 60 to be opened smoothly.

The present invention is not limited to the above-mentioned embodiments, and various changes can be made within the scope that does not depart from the gist of the present invention. Further, in addition to the color printer as illustrated in FIG. 1 and FIG. 3, the present invention can be applied to other image forming apparatuses such as a copier, a facsimile machine, and a multifunction peripheral (MFP; having a combination of functions including copying, facsimile, scanning, and printing).

What is claimed is:

1. A process unit positioning device, which performs mutual positioning of process units individually comprising photosensitive drums corresponding to different colors of toner with respect to an apparatus main body, comprising:

a positioning plate in which bearing holes into which individual drum shafts of the respective photosensitive drums are fitted and a positioning portion onto which the apparatus main body is fitted are formed;

a holder portion provided to the apparatus main body, for inserting/removing the drum shafts relatively into/from the bearing holes by being caused to pivot while holding the positioning plate; and an urging member for urging the positioning plate toward the drum shafts in an axial direction with respect to the holder portion, wherein the holder portion holds the positioning plate so that a position with respect to the holder portion changes against urging of the urging member by contact between the bearing holes and the drum shafts when the drum shafts are fitted into the bearing holes by the pivot.

2. A process unit positioning device according to claim 1, wherein the holder portion comprises:

a hook that is engaged with the apparatus main body into which the respective process units are loaded; and a lever that is fixed to a pivot shaft for pivoting the hook, and that releases engagement of the hook with the apparatus main body by causing the hook to pivot.

3. A process unit positioning device according to claim 2, wherein the positioning plate comprises an insertion portion in which an insertion port through which the pivot shaft for pivoting the hook is inserted with a clearance is formed.

4. A process unit positioning device according to claim 3, wherein:

the positioning plate is a sheet metal member and comprises a flat plate portion having a flat plate shape;

the respective bearing holes and the positioning portion are formed in the flat plate portion; and the insertion portion is erected on the flat plate portion.

5. A process unit positioning device according to claim 1, wherein the positioning portion of the positioning plate is provided with a positioning pin that protrudes toward the apparatus main body with a positioning hole into which the positioning pin is fitted being formed on a side of the apparatus main body.

6. A process unit positioning device according to claim 5, wherein:

the respective bearing holes and the positioning pin of the positioning plate are located in the same straight line; and the urging member urges the positioning plate toward the apparatus main body near the positioning pin.

7. An image forming apparatus, comprising:

the process unit positioning device according to claim 1; and process units individually comprising photosensitive drums corresponding to different colors of toner, wherein the process unit positioning device performs mutual positioning of the respective process units.

8. An image forming apparatus according to claim 7, wherein a pivot shaft of the holder portion of the process unit positioning device is located in parallel with a direction in which respective drum shafts of the respective process units are arrayed and is located above the respective drum shafts.

9. An image forming apparatus according to claim 8, wherein:

the holder portion is supported by the pivot shaft so as to be free to pivot vertically with respect to the apparatus main body;

the holder portion pivots toward a first position; a second position in which the holder portion is caused to pivot upward from the first position by a predetermined amount; and a third position in which the holder portion is caused to further pivot upward from the second position by a predetermined amount to open front surfaces of the process units; and the image forming apparatus comprises a holder urging member that urges the holder portion toward such a direction as to cause the holder portion to pivot downward when the holder portion is in the first position and the second position, and that, when the holder portion is caused to pivot upward from the second position by a predetermined angle, changes an urging direction of the holder portion toward such a direction as to cause the holder portion to pivot upward.

10. An image forming apparatus according to claim 9, wherein:

the holder urging member is a tension spring having one end fixed to the holder portion and another end fixed to the apparatus main body; and when the holder portion is positioned in the second position, the straight line passing a fulcrum of the tension spring on the apparatus main body and the pivot shaft of the holder portion is located above the tension spring.

11. An image forming apparatus according to claim 9, wherein the holder urging member is allowed to hold the holder portion in the third position.

12. An image forming apparatus according to claim 7, further comprising:

a plurality of developing units individually comprising developing rollers for supplying the toner on the respective photosensitive drums of the respective process units, which are arranged adjacent to the respective process units so as to be detachable/attachable;

a roller separating/contacting mechanism for causing the respective developing rollers to approach or retract from the respective photosensitive drums; and a holder urging member for urging the holder portion toward a predetermined pivot direction, wherein:

the roller separating/contacting mechanism comprises:

a shaft member provided so as to protrude from and sink into a surface of each of the plurality of developing units which is opposed to the positioning plate; and a shaft urging member for urging the shaft member toward such a direction as to protrude from the surface of each of the plurality of developing units;

the holder portion pivots toward a first position, a second position, and a third position;

the first position is a pivot position in which the shaft member is depressed by the positioning plate against an urging force of the shaft urging member to be pushed into each of the plurality of developing units and each of the drum shafts of each of the photosensitive drums is fitted into each of bearing holes of the positioning plate;

the second position is a pivot position in which a tip of the shaft member is brought into abutment with the positioning plate when the shaft member is caused to protrude at maximum from the surface of each of the plurality of developing units by the urging force of the shaft urging member;

the third position is a pivot position in which the abutment between the tip of the shaft member and the positioning plate is released to open front surfaces of the process units and the plurality of developing units; and the holder urging member urges the holder portion toward such a pivot direction as to approach the process units and the plurality of developing units when the holder portion is in the first position and the second position, and when the holder portion is in the third position, urges the holder portion toward such a pivot direction as to move away from the process units and the plurality of developing units.

13. An image forming apparatus according to claim 12, wherein the holder portion is urged by the holder urging member toward an urging direction that changes between the second position and the third position.

* * * * *